US011976534B2

(12) United States Patent
Guidry et al.

(10) Patent No.: US 11,976,534 B2
(45) Date of Patent: May 7, 2024

(54) WELLHEAD ASSEMBLY VALVE SYSTEMS AND METHODS

(71) Applicant: Cameron International Corporation, Houston, TX (US)

(72) Inventors: Kirk P. Guidry, Cypress, TX (US); Dennis P. Nguyen, Pearland, TX (US); Ebtihal Chafroud, Houston, TX (US); Stuart Robinson, Katy, TX (US); Haw Keat Lim, Singapore (SG); Loc Hoang, Houston, TX (US)

(73) Assignee: Cameron International Corporation, Houston, TX (US)

( * ) Notice: Subject to any disclaimer, the term of this patent is extended or adjusted under 35 U.S.C. 154(b) by 105 days.

(21) Appl. No.: 17/595,520

(22) PCT Filed: Jun. 3, 2020

(86) PCT No.: PCT/US2020/035870

§ 371 (c)(1),
(2) Date: Nov. 18, 2021

(87) PCT Pub. No.: WO2020/247460

PCT Pub. Date: Dec. 10, 2020

(65) Prior Publication Data

US 2022/0228462 A1 Jul. 21, 2022

Related U.S. Application Data

(60) Provisional application No. 62/960,673, filed on Jan. 13, 2020, provisional application No. 62/856,553, filed on Jun. 3, 2019.

(51) Int. Cl.

| | |
|---|---|
| ***E21B 34/02*** | (2006.01) |
| ***E21B 33/03*** | (2006.01) |
| ***E21B 33/12*** | (2006.01) |

(52) U.S. Cl.
CPC ..... *E21B 34/02* (2013.01); *E21B 33/03* (2013.01); *E21B 33/12* (2013.01)

(58) Field of Classification Search
CPC ..... E21B 34/02; E21B 33/03; E21B 33/12
See application file for complete search history.

(56) References Cited

U.S. PATENT DOCUMENTS 2,859,010 A * 11/1958 Ferrell ..... E21B 34/02 251/59
3,072,142 A 1/1963 Yancey
(Continued)

FOREIGN PATENT DOCUMENTS

| | | |
|---|---|---|
| GB | 2132728 A | 7/1984 |
| GB | 2346630 A | 8/2000 |
| WO | 2018106119 A2 | 6/2018 |

OTHER PUBLICATIONS

International Search Report and Written Opinion issued in the PCT Application PCT/US2020/035870, dated Sep. 21, 2020 (18 pages).

*Primary Examiner* — Steven A MacDonald
(74) *Attorney, Agent, or Firm* — Eubanks PLLC

(57) ABSTRACT

An apparatus includes a valve coupled to a pressure-containing component of a wellhead assembly. The pressure-containing component can include a hollow body, a bore within the hollow body, and an access passage that is in the hollow body and is in fluid communication with the bore. The valve can include a sealing element that is positioned along the access passage and is selectively moveable between closed and open positions to control fluid flow through the access passage. During operation, the sealing element may be moved between the closed and open positions without actuating the sealing element through an outer end of the access passage. Additional systems, devices, and methods are also disclosed.

19 Claims, 22 Drawing Sheets

(56) References Cited

U.S. PATENT DOCUMENTS 3,466,001 A 9/1969 Nelson
4,503,879 A * 3/1985 Lazarus ..... F16L 55/128 138/94
4,662,603 A 5/1987 Etheridge
5,299,640 A * 4/1994 Streich ..... E21B 33/16 166/327
5,497,672 A * 3/1996 Appleford ..... E21B 34/04 251/71
5,918,627 A 7/1999 Oshiro
6,050,338 A * 4/2000 Watkins ..... E21B 33/043 166/368
6,086,039 A 7/2000 Sievers et al.
6,186,239 B1 2/2001 Monjure et al.
6,695,049 B2 * 2/2004 Ostocke ..... E21B 34/02 166/97.1
6,957,703 B2 10/2005 Trott et al.
7,566,045 B2 7/2009 June
8,181,705 B2 5/2012 Tveiten et al.
8,186,440 B2 5/2012 Tveiten et al.
8,261,771 B2 9/2012 Witkowski et al.
8,640,776 B2 2/2014 Tveiten et al.
8,684,073 B2 4/2014 Sevheim et al.
9,422,789 B2 8/2016 Bushman et al.
9,500,062 B2 11/2016 Tveiten et al.
11,261,978 B2 3/2022 Pivowar et al.
2002/0017384 A1 * 2/2002 Ostocke ..... E21B 34/02 166/85.1
2002/0020558 A1 2/2002 Gonzalez et al.
2002/0153143 A1 10/2002 Compton et al.
2003/0019631 A1 1/2003 DeBerry
2003/0150620 A1 8/2003 DeBerry et al.
2006/0060348 A1 3/2006 Allen et al.
2006/0254822 A1 * 11/2006 Ayling ..... E21B 19/165 175/218
2007/0169940 A1 7/2007 Fenton et al.
2009/0020382 A1 1/2009 Van Weelden et al.
2010/0044054 A1 2/2010 de Boer
2012/0152564 A1 6/2012 Peltier
2012/0222760 A1 * 9/2012 Marica ..... F04B 23/10 137/538
2014/0000907 A1 1/2014 Olvera et al.
2015/0345253 A1 12/2015 Braekke
2016/0010417 A1 1/2016 Lockwood
2017/0037980 A1 2/2017 Arian et al.
2017/0175488 A1 6/2017 Lisowski et al.
2017/0284277 A1 10/2017 Wardle et al.
2018/0010420 A1 * 1/2018 Shirley ..... F16K 27/0209
2019/0277137 A1 * 9/2019 Gray ..... E21B 33/12
2020/0088004 A1 * 3/2020 Tibbs ..... E21B 33/068

* cited by examiner

WELLHEAD ASSEMBLY VALVE SYSTEMS AND METHODS

CROSS-REFERENCE TO RELATED APPLICATIONS

This application is a National Stage of International Application No. PCT/US2020/035870, filed Jun. 3, 2020, and claims the benefit of U.S. Provisional Application No. 62/856,553, entitled "INTEGRATED ANNULUS VALVE SYSTEM AND METHOD," filed Jun. 3, 2019, and U.S. Provisional Application No. 62/960,673, entitled "WELLHEAD ASSEMBLY VALVE SYSTEMS AND METHODS," filed Jan. 13, 2020, the disclosure of each of which is hereby incorporated herein by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, wellhead components, trees, valves, fluid conduits, and the like.

Various wellhead assembly components and other oilfield components can include ports for accessing internal volumes. A wellhead can include access ports in fluid communication with various annuli in the well, for example. External valves, such as gate valves, can be attached to the side of the wellhead to control flow through the outlet ports. In some instances, a plug may be installed through an external valve and threaded into an outlet port to seal the outlet port and allow the external valve to be removed from the wellhead.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to valve assemblies for controlling flow into or out of a wellhead, tree, or other oilfield component. In some embodiments, a pressure-containing component of a wellhead assembly includes an internal valve integrated into a body of the pressure-containing component. The body can include a bore and an access passage in fluid communication with the bore, and the internal valve can include a sealing element positioned along the access passage in the body to control flow through the access passage. Examples of the sealing element include plugs, gates, and balls that can be moved between an open position to allow flow through the access passage and a closed position to block flow. In some instances, the sealing element can be moved between these positions without actuating the sealing element through an outer end of the access passage and without the valve protruding outside the pressure-containing component from the access passage.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
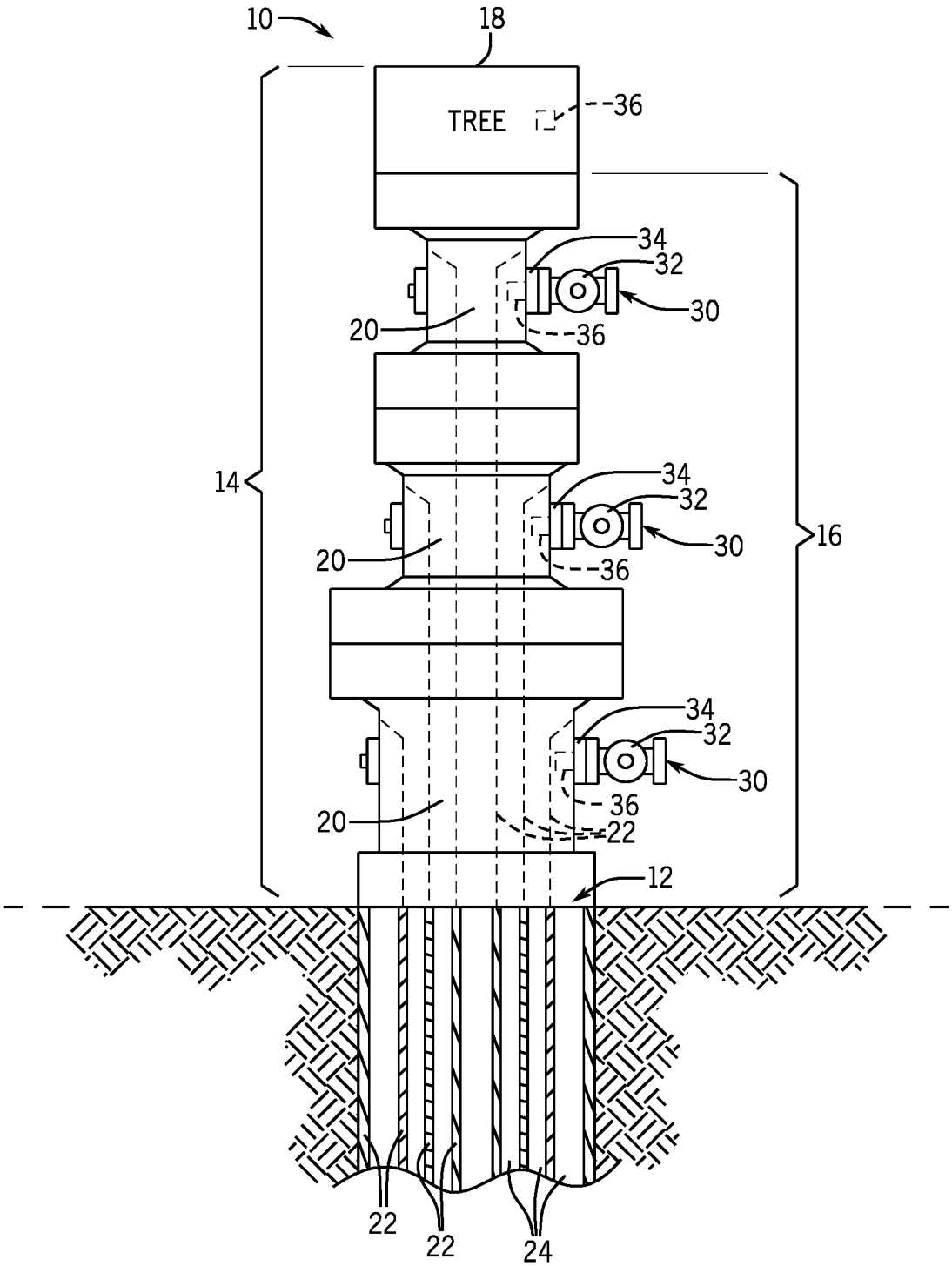
FIG. 1 depicts a well apparatus including pressure-containing components having integrated valves for controlling flow into or out of the components in accordance with an embodiment of the present disclosure.

Turning now to the present figures, an apparatus 10 is illustrated in FIG. 1 by way of example. The apparatus 10 is a well installation that facilitates production of a resource, such as oil or gas, from a reservoir through a well 12. A wellhead assembly 14 of the apparatus 10 in FIG. 1 includes a wellhead 16 and a tree 18. The wellhead 16 is depicted as having heads 20 (e.g., casing and tubing heads), but the components of the wellhead 16 can differ between applications and could include a variety of casing heads, tubing heads, spools, hangers, sealing assemblies, valves, and pressure gauges, to name only a few possibilities. The tree 18 may be a production tree, a fracturing tree, or some other tree coupled to the wellhead 16.

Various tubular strings 22, such as casing and tubing strings, extend into the ground below the wellhead assembly 14. As will be appreciated, casing strings generally serve to stabilize wells and to isolate fluids within wellbores from certain formations penetrated by the wells (e.g., to prevent contamination of freshwater reservoirs), and tubing strings facilitate flow of fluids through the wells. Hangers can be attached to casing and tubing strings and received within wellheads to enable these tubular strings to be suspended in the wells from the hangers. The wellhead assembly 14 can be mounted on the outermost tubular string 22 (e.g., a conductor pipe) and each of the remaining tubular strings 22 may extend downwardly into the ground from a casing or tubing head 20. In one embodiment, the innermost tubular string 22 is a tubing string and the remaining tubular strings 22 are casing strings.

The tubular strings 22 define annular spaces 24, which may also be referred to as annuli 24. Valve assemblies 30 may be used to selectively permit flow between the wellhead assembly 14 and external equipment. In FIG. 1, the valve assemblies 30 include external gate valves 32 mounted outside the casing and tubing heads 20 and in-line with annulus access passages in the heads 20 to control flow between the annuli 24 and external equipment through the access passages. The gate valves 32 could be mounted directly to the heads 20, but in some embodiments one or more other components are interposed between the gate valves 32 and the heads 20. In FIG. 1, for instance, separate flanges 34 (e.g., instrument flanges) are installed between the gate valves 32 and the heads 20.

In addition to or instead of the external valves 32, valves 36 may be integrated into pressure-containing components of the wellhead 16 (e.g., in heads 20), the tree 18, or other equipment to control flow through access passages. In some embodiments, for instance, valves 36 may be integrated into hollow bodies of such pressure-containing components to control flow through access passages in fluid communication with bores in the components. More specifically, the valves 36 may be used as annulus safety valves installed in ports of the wellhead 16 to control access to the annuli 24 in some cases, but the valves 36 may be used in different applications in other cases. These internal valves 36 can include sealing elements that can be moved between an open position to allow flow through an access passage and a closed position to block flow through the access passage. Consequently, the valves 36 can be opened to enable fluid flow into or out of the components. In certain embodiments, the valves 36 are positioned fully within a hollow body of a pressure-containing component (e.g., along an access passage) and do not protrude outwardly from the pressure-containing component. Further, in at least some instances an internal valve 36 in an access passage of a pressure-containing body (e.g., an annulus outlet port of a wellhead) can be used, in lieu of a separate valve-removal (VR) plug in the access passage, to block flow through the access passage and facilitate removal of an external valve 32 attached in fluid communication with the access passage. Such an internal valve 36, which may be referred to as a valve-removal (VR) valve, can remain in the access passage to control flow even after removal of the external valve 32.

Figure 2:
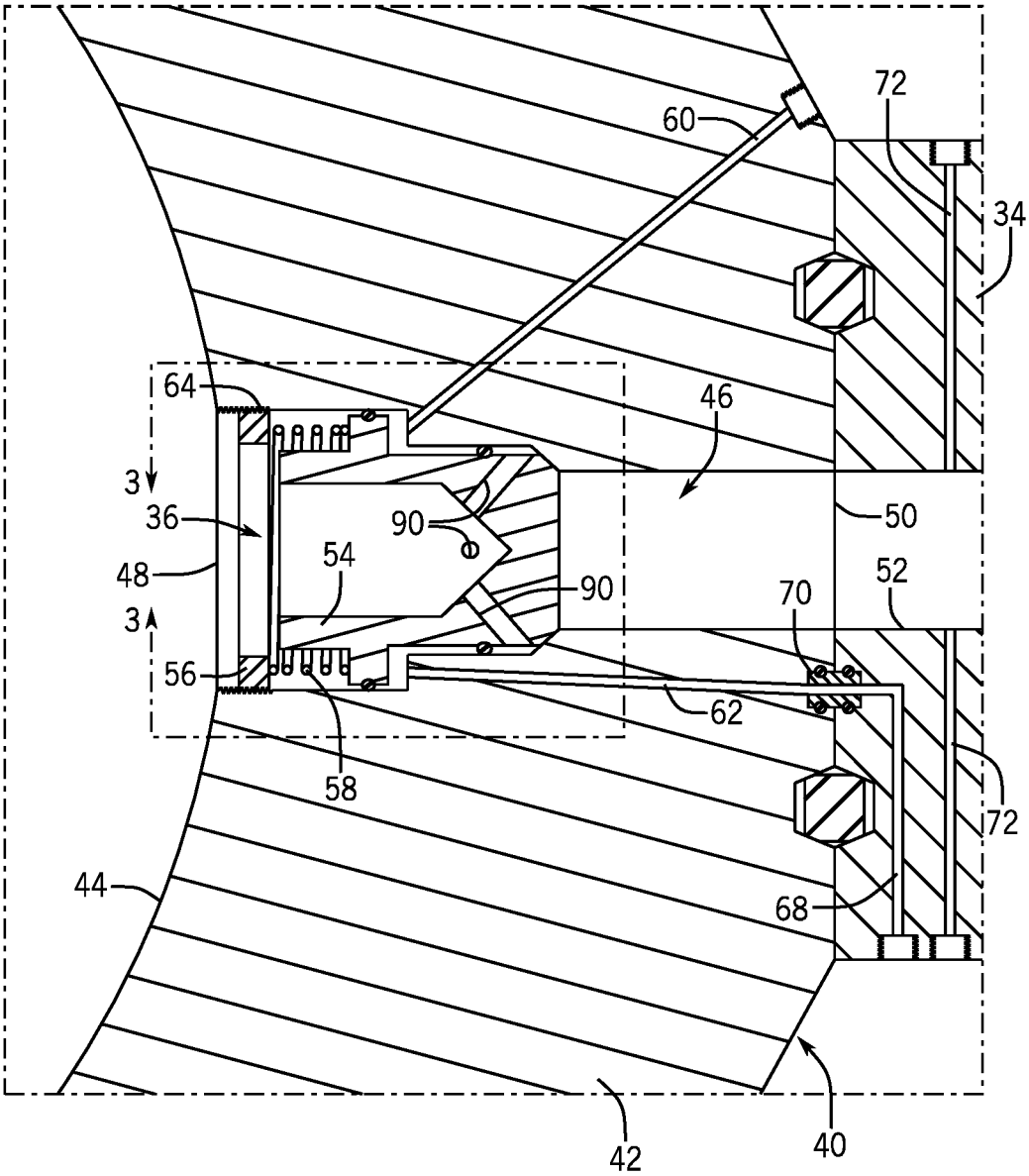
FIG. 2 is a cross-section of a portion of a pressure-containing component having an integrated valve with a moveable plug for controlling flow through an access passage of the component in accordance with one embodiment.

One example of an internal valve 36 is shown in FIG. 2 as being integrated into a pressure-containing component 40 of the wellhead assembly 14 (e.g., in the tree 18 or a head 20). The pressure-containing component 40 includes a hollow body 42 with a bore 44 and an access passage 46 in fluid communication with the bore 44. Although a single access passage 46 is depicted in FIG. 2, the body 42 may include additional access passages 46, any or each of which could also include an internal valve 36. In the presently illustrated embodiment, the access passage 46 in the body 42 includes an inner end 48 and an outer end 50. In certain embodiments, the access passage 46 could be an annulus access passage, which may also be referred to as an annulus outlet port, in fluid communication with one of the annuli 24 in the well 12 (e.g., an "A" annulus, a "B" annulus, or a "C" annulus). A flange 34 is shown attached to the body 42 such that a bore 52 of the flange 34 is in-line with the access passage 46. The flange 34 could be a spool flange, a valve flange, or an instrument flange, to name several examples.

In at least some embodiments, the valve 36 includes a sealing element that is moved between a closed position and an open position without actuating the sealing element through the outer end 50 of the access passage 46 (e.g., without using an actuator installed so as to extend into the access passage 46 through the outer end 50). By way of example, the valve 36 is shown in FIG. 2 as having a sealing element in the form of a moveable plug 54 installed along the access passage 46. The plug 54 may be retained in the access passage 46 with a retaining ring 56 and biased toward a closed, sealing position by a spring 58. During assembly, the plug 54 can be inserted into the access passage 46 from the bore 44 through the inner end 48. While the retaining ring 56 is threaded into the access passage 46 behind the plug 54 via a threaded interface 64 in some embodiments, such as shown in FIG. 2, the retaining ring 56 could be secured to the body 42 behind the plug 54 in some other fashion. In still other embodiments, the ring 56 could be omitted and the plug 54 could be retained in the passage 46 in some other suitable manner.

Generally, the plug 54 may be moved between a closed position that blocks flow through the access passage 46 and an open position that allows flow through the passage 46. In some embodiments, the plug 54 acts as both a movable sealing element of the internal valve 36 (e.g., an annulus safety valve) and a VR plug facilitating removal or omission of an external valve 32 from the body 42; in such cases the plug 54 may also be referred to as an actuatable VR plug. Although the plug 54 could be actuated in other ways, in some instances the plug 54 is a hydraulically actuated plug controlled by routing control fluid to the valve through an actuation passage. As shown in FIG. 2, for example, control fluid may be routed to the valve 36 through a hydraulic control passage 60 or 62 in the body 42. Rather than passing through a device (e.g., a valve housing) installed in the access passage 46, the passages 60 and 62 are in the body 42 independent of the access passage 46.

The passage 60 is accessible at the exterior surface of the body 42 with the flange 34 mounted to the body 42. In contrast, the passage 62 extends to a face of the body 42 covered by the flange 34. While the flange 34 could be removed to access the passage 62 in some instances, hydraulic control fluid may be routed into the passage 62 through another actuation passage, such as hydraulic control passage 68 of flange 34. The apparatus can include a sealing sub 70 or any other suitable sealing arrangement to inhibit leakage where the passages 62 and 68 meet. Although the body 42 may have both passages 60 and 62, such as shown in FIG. 2, in some embodiments either of these passages may be omitted while allowing hydraulic control of the valve 36 through the other.

The flange 34 may include one or more conduits 72. Two such conduits 72 are shown in FIG. 2 as extending through the flange 34 to its bore 52 and may be used to measure pressure, temperature, or some other characteristic of fluid in the flange 34. As will be appreciated, various sensors, gauges, meters, or other devices may be used in such measurements. Pressure, temperature, or other characteristics of fluid within the pressure-containing component 40 may also or instead be measured through the body 42.

Figure 3:
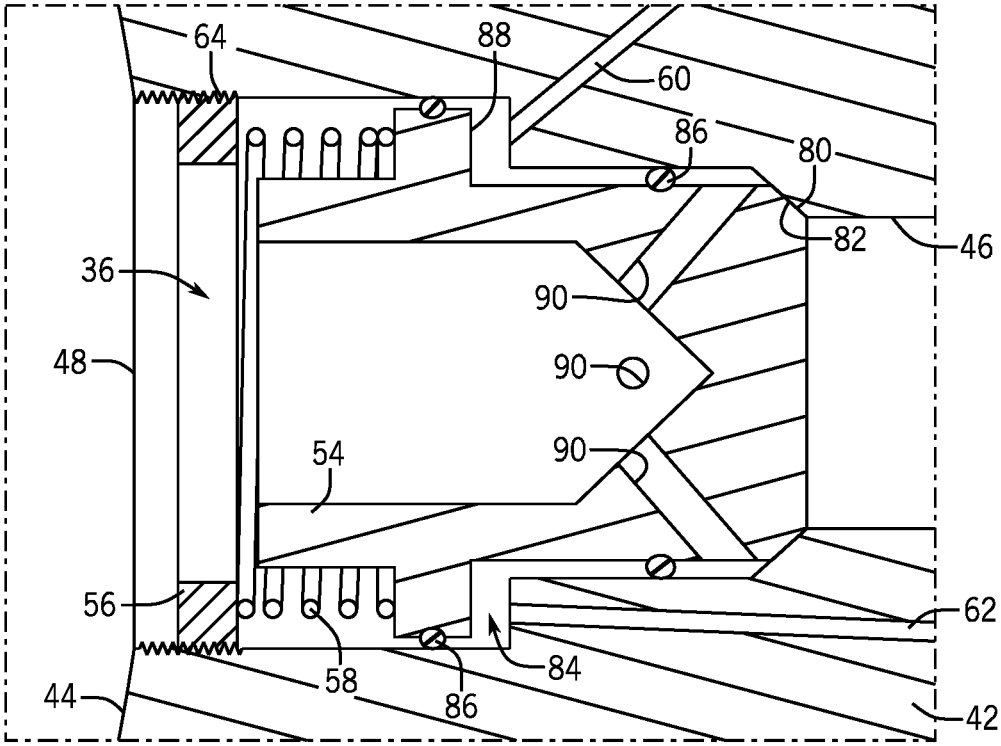
FIG. 3 is a detail view of the valve of FIG. 2 and shows the plug in a closed position blocking flow through the access passage.
Figure 4:
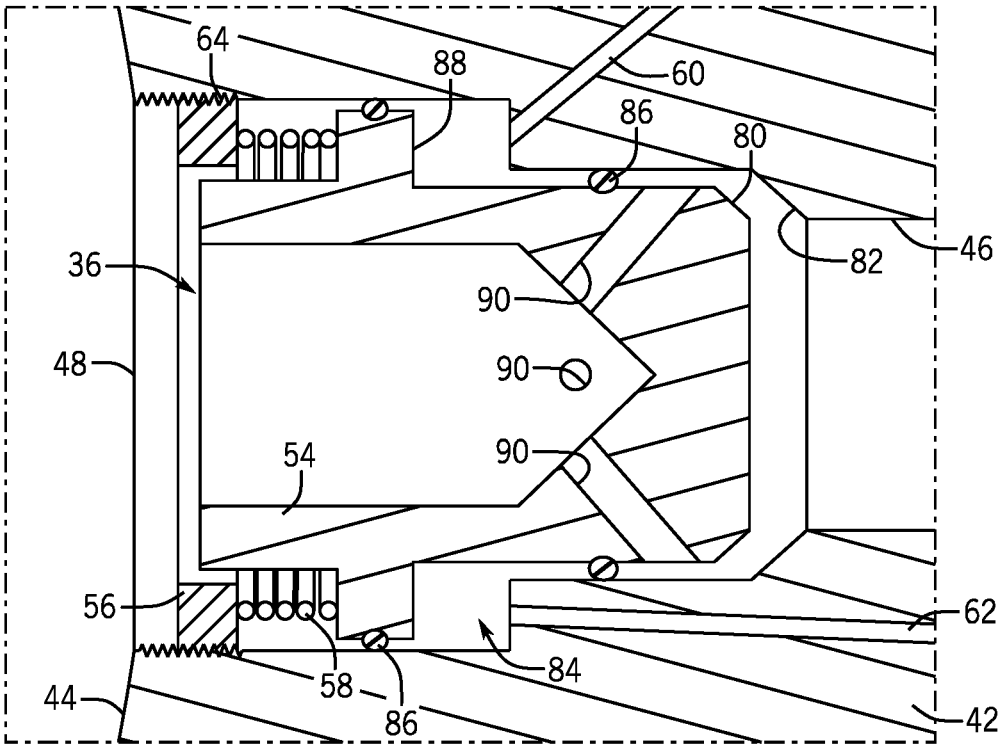
FIG. 4 is a detail view of the valve of FIGS. 2 and 3 and shows the plug in an open position allowing flow through the access passage.

As shown in the detailed views of FIGS. 3 and 4, the plug 54 and the body 42 include mating seating surfaces 80 and 82. In at least some embodiments, these surfaces 80 and 82 are metal sealing surfaces forming a metal-to-metal seal when the plug 54 is in the closed position seated against the body 42, as depicted in FIG. 3. In other instances, either or both surfaces 80 and 82 may carry a seal (e.g., a thermoplastic, elastomer, or metal seal) that presses and seals against the opposing surface or seal when the plug 54 is in the closed position. In some cases, the surfaces 80 and 82 may seal with both a metal-to-metal seal and a carried elastomer or thermoplastic seal.

The valve 36 may be opened by routing control fluid into a control chamber 84 to push the plug 54 off the seat 82 to an open position. Seals 86 isolate the control chamber 84 from other fluid regions, and the control chamber 84 is bounded in part by a shoulder 88 of the plug 54. In operation, control fluid (e.g., a hydraulic control fluid) may be routed into the control chamber 84, such as through passage 60 or 62, to pressurize the chamber 84 and push the plug 54 (via the shoulder 88) to an open position, as generally shown in FIG. 4. The body of plug 54 includes one or more fluid ports 90 to allow flow through the plug 54 when in the open position. The characteristics of the ports 90 (e.g., size, number, and arrangement) may vary between embodiments, such as to optimize flow through the open plug 54. To close the plug 54, the pressure in the chamber 84 can then be reduced (e.g., by allowing control fluid to exit the chamber 84) such that the spring 58 pushes the plug 54 back to its seated position of FIG. 3.

Figure 6:
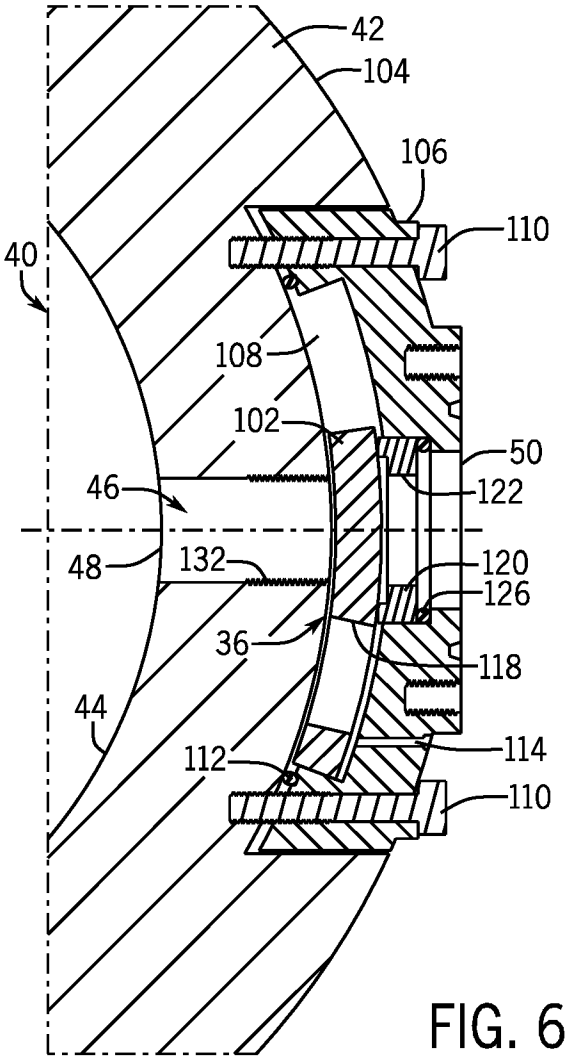
FIG. 6 is similar to FIG. 5 but shows the gate in a closed position blocking flow through the access passage.
Figure 5:
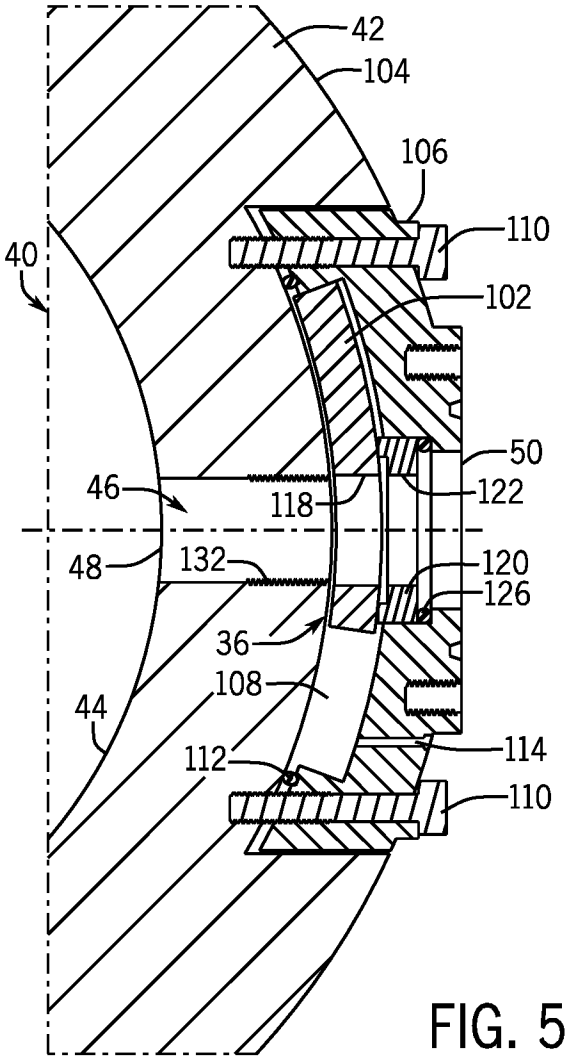
FIG. 5 is a cross-section of a portion of a pressure-containing component having an integrated valve with a moveable gate for controlling flow through an access passage of the component, and shows the gate in an open position allowing flow through the access passage, in accordance with one embodiment.

Another example of an internal valve 36 integrated into the pressure-containing component 40 is shown in FIGS. 5 and 6 as having a sealing element in the form of a moveable gate 102 installed along the access passage 46. The gate 102 can be integrated into the body 42 of the pressure-containing component 40 in any suitable manner. In FIGS. 5 and 6, for instance, the body 42 includes a first body portion 104 and a second body portion 106, and the gate 102 is installed in a cavity 108 between the first and second body portions 104 and 106. The depicted body portions 104 and 106 are constructed such that the second body portion 106 is a cover inserted in a recessed portion of the first body portion 104. But the body portions 104 and 106 could be constructed in other ways, such as the second body portion 106 serving as a cover that attaches to a non-recessed surface of the first body portion 104.

Figure 7:
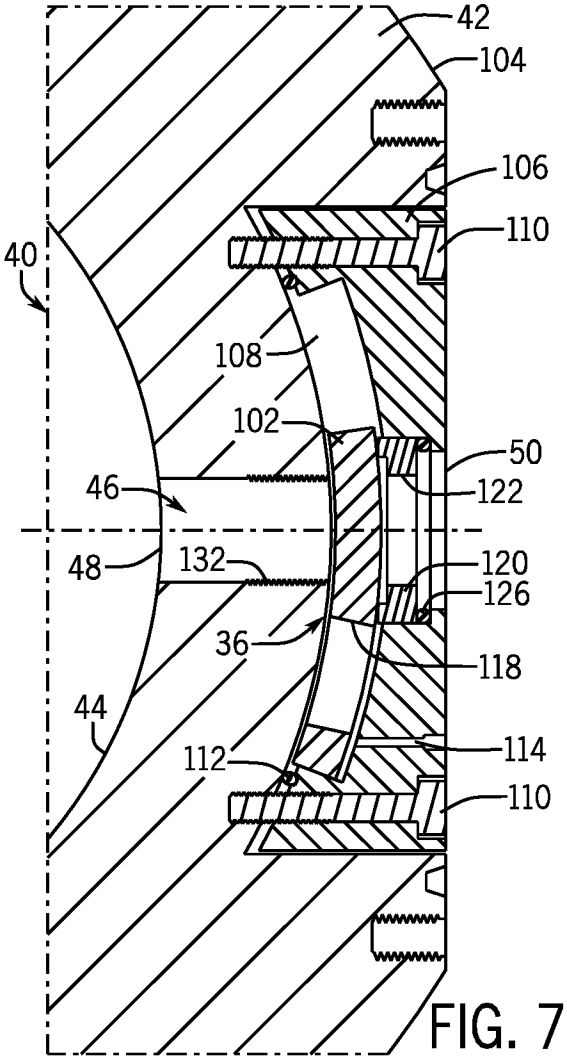
FIG. 7 depicts an integrated valve with a moveable gate in accordance with one embodiment, with a sealing groove and mounting holes positioned differently than in FIG. 6 for mounting an external component.

The second body portion 106 may be connected to the first body portion 104 with fasteners (e.g., bolts 110) or in some other manner to enclose the gate 102 in the cavity 108. A gasket or other seal 112 isolates the cavity 108 from the surrounding environment. The second body portion 106 can include a port 114 that, in at least some embodiments, facilitates measurement of a characteristic of fluid (e.g., temperature and pressure) within the cavity 108. As shown in FIGS. 5 and 6, the outer end of the second body portion 106 also includes a sealing groove and mounting holes (e.g., a bolt circle) to facilitate connection of another component (e.g., a gate valve 32 or an instrument flange 34) to the body 42. But in some other embodiments, an example of which is depicted in FIG. 7, the first body portion 104 also or instead includes such a sealing groove and mounting holes (e.g., a bolt circle) to facilitate connection of a gate valve 32, instrument flange 34, or other component to the first body portion 104 of the body 42. As shown in FIG. 7, the sealing groove in the first body portion 104 surrounds the second body portion 106 such that a gasket or other seal received within the sealing groove (e.g., when an external valve 32 or flange 34 is fastened to the first body portion 104 via the mounting holes) encloses the second body portion 106.

The gate 102 includes an aperture 118 and can be moved across the access passage 46 between an open position (FIG. 5) to allow flow through the access passage 46 and a closed position (FIG. 6) to block such flow. Like discussed above with the plug 54, the gate 102 can be moved to the closed position to facilitate removal of an external valve 32 (or other equipment) from the body 42. A seat 120 with an aperture 122 seals against the gate 102. When the gate 102 is in the open position, the seat 120 seals around the aperture 118, and the aperture 122 of the seat 120 is aligned with the aperture 118 to allow flow through the access passage 46. A seal 126 inhibits leakage between the seat 120 and the body 42 (e.g., second body portion 106 in FIG. 5) and can also push the seat 120 toward the gate 102.

In FIGS. 5 and 6, the gate 102 is a curved gate that travels an arcuate path across the access passage 46 between the open and closed positions. But the gate 102 may have a different shape, such as a flat or wedge-shaped gate, in other instances. Additionally, while the seat 120 is shown abutting the front face of the gate 102 in FIGS. 5 and 6, in other embodiments the seat 120 could abut the rear face of the gate 102 or multiple seats 120 could be used to abut both the front and rear faces of the gate 102.

Figure 8:
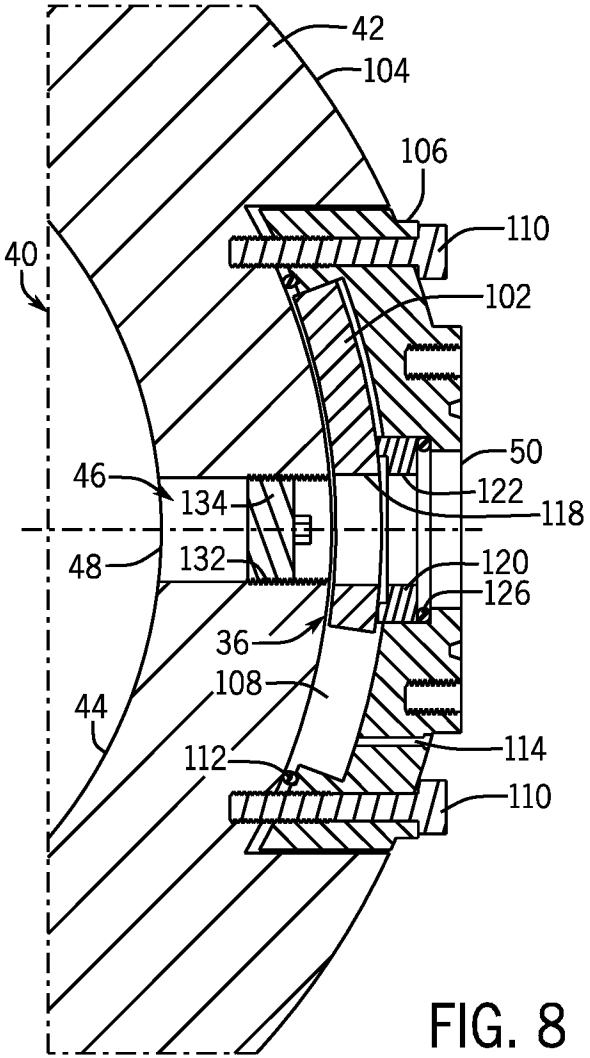
FIG. 8 shows a sealing plug installed in the access passage of FIG. 5 through an aperture of the gate in accordance with one embodiment.

In addition to or instead of the gate 102, a plug can be installed to block flow into or out of the pressure-containing component 40 through the access passage 46. One example of this is shown in FIG. 8, in which a sealing plug 134 (e.g., a VR plug) is threaded to a threaded surface 132 (e.g., a VR preparation) of the body 42. In some embodiments, the plug 134 can be installed by opening the gate 102, running the plug 134 through the outer end 50 of the access passage 46 and the aperture 118 of the open gate 102, and then rotating the plug 134 to engage the threaded surface 132 of the access passage 46 with a mating thread of the plug 134. As will be appreciated, the plug 134 may be installed in the access passage 46 using a suitable installation tool, such as a tool having a lubricator coupled directly or indirectly to the exterior of the second body portion 106 and a telescoping arm to position the plug 134 in the access passage 46. The plug 134 and the gate 102 can serve as two pressure barriers along the access passage 46, even with the removal or omission of an additional, external valve (e.g., gate valve 32) connected in-line with the access passage 46. In other instances, the plug 134 may be installed behind the gate 102, such as shown in FIG. 8, to facilitate removal of the second body portion 106 for servicing or removal of the valve 36.

Figure 9:
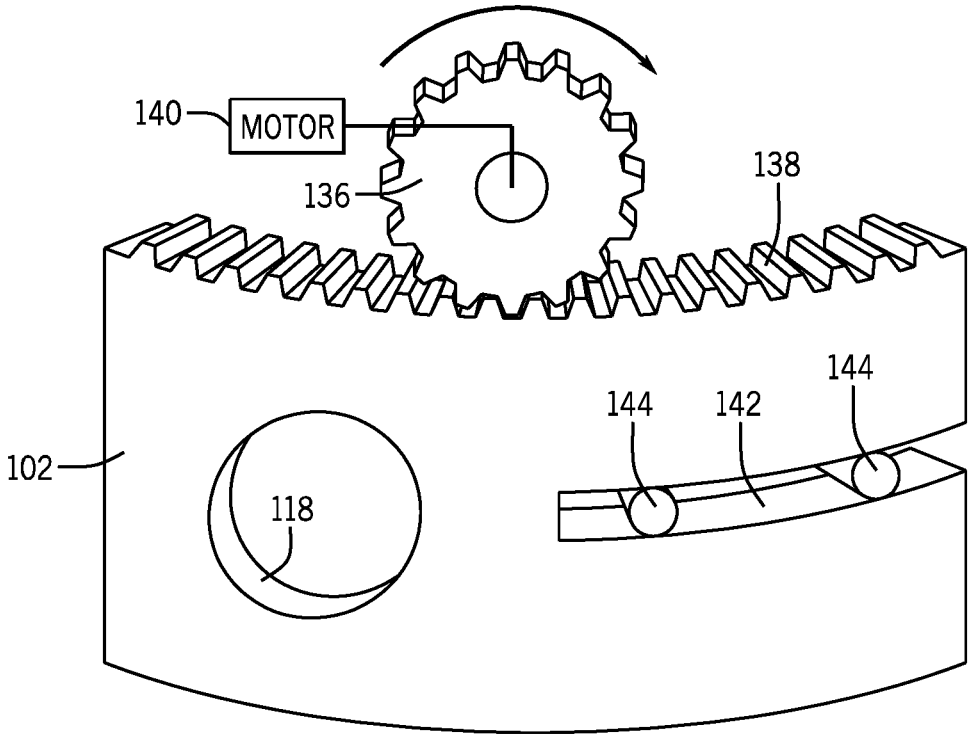
FIG. 9 generally depicts mechanical actuation of the gate and alignment pins for guiding movement of the gate during operation in accordance with one embodiment.

The gate 102 can be actuated in any suitable manner. In some embodiments the gate 102 is moved with a mechanical actuator. One example of this is generally depicted in FIG. 9, in which a gear 136 drives movement of the gate 102 between the open and closed positions. Teeth of the gear 136 engage a mating surface 138 such that rotation of the gear 136 moves the gate 102 along its path across the access passage 46. A motor 140, such as an electric motor, a hydraulic motor, or an electrohydraulic motor, may be connected to drive rotation of the gear 136. In other embodiments, a motor 140 could be used with a linear actuator to push or pull the gate 102 along its path.

The gate 102 can include various alignment features that help guide and facilitate travel between the open and closed positions. By way of example, the gate 102 is shown in FIG. 9 as having an alignment slot 142 for receiving one or more alignment pins 144. The depicted alignment pins 144 are arranged horizontally and can help maintain the vertical position of the gate 102 (and engagement with the gear 136) as the gate 102 moves between the open and closed positions. Alignment pins 144 could also or instead be provided in other orientations, such as one or more vertical pins 144 received by the gate 102 to help maintain horizontal position of the gate 102 in operation.

Figure 10:
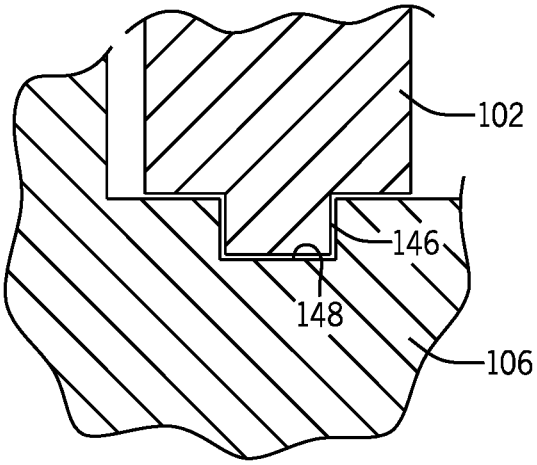
FIG. 10 generally depicts a tongue-and-groove arrangement for guiding movement of the gate during operation in accordance with one embodiment.

In some embodiments, the gate 102 may also or instead include a tongue-and-groove arrangement to limit movement of the gate 102 in one or more directions. In FIG. 10, for example, the gate 102 includes a tongue 146 received in a mating groove 148 of the second body portion 106. Although generally depicted on a lower end of the gate 102, it will be appreciated that a tongue 146 may also or instead be provided on other portions of the gate 102.

Figure 11:
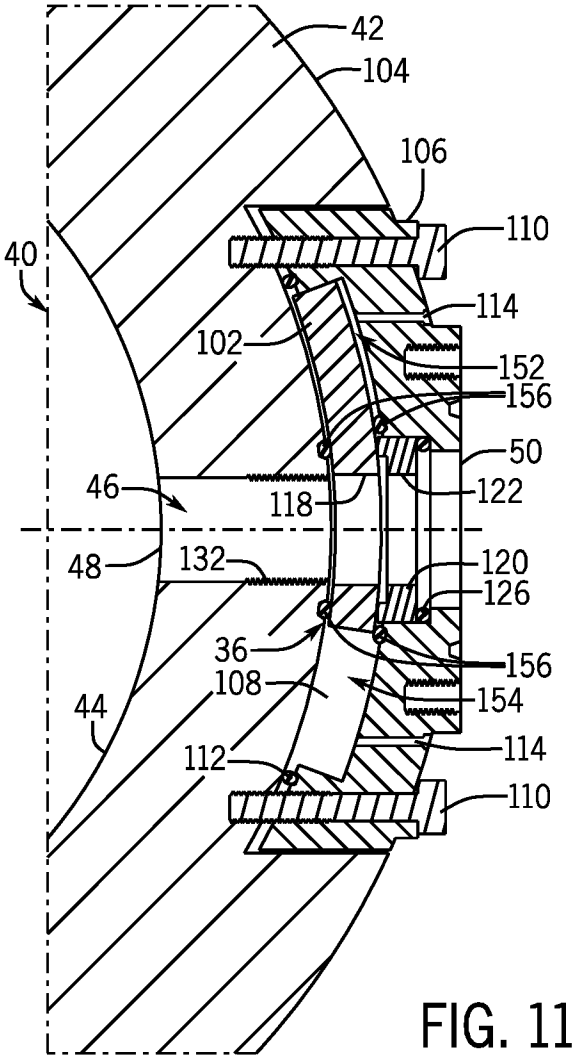
FIG. 11 is similar to FIG. 5 but includes ports and seals to facilitate hydraulic actuation of the gate to control flow through the access passage in accordance with one embodiment.

The gate 102 can be driven hydraulically in some other embodiments. As generally depicted in FIG. 11, for example, the gate 102 can be moved to the closed position by routing control fluid into a control chamber 152 of the cavity 108 and to the open position by routing control fluid into a control chamber 154 of the cavity 108. More specifically, in the presently depicted embodiment, control fluid may be routed into the control chamber 152 through a port 114 to pressurize the chamber 152 and act on the end of the gate 102 to cause the gate 102 to move to the closed position. Similarly, control fluid may be routed into the control chamber 154 through another port 114 to pressurize the chamber 154 and act on the opposite end of the gate 102 to cause the gate 102 to return to the open position. The control chambers 152 and 154 may be isolated from other portions of the cavity 108 and from the access passage 46 with any suitable seals 156. In yet another embodiment, the hydraulically actuated gate 102 could be spring-biased (e.g., fail-safe closed), such that hydraulic pressure in a control chamber (e.g., chamber 154) is used to drive the gate 102 to one position (e.g., the open position), while a biasing spring pushes the gate 102 to the other position upon a sufficient drop in pressure in that control chamber.

Figure 12:
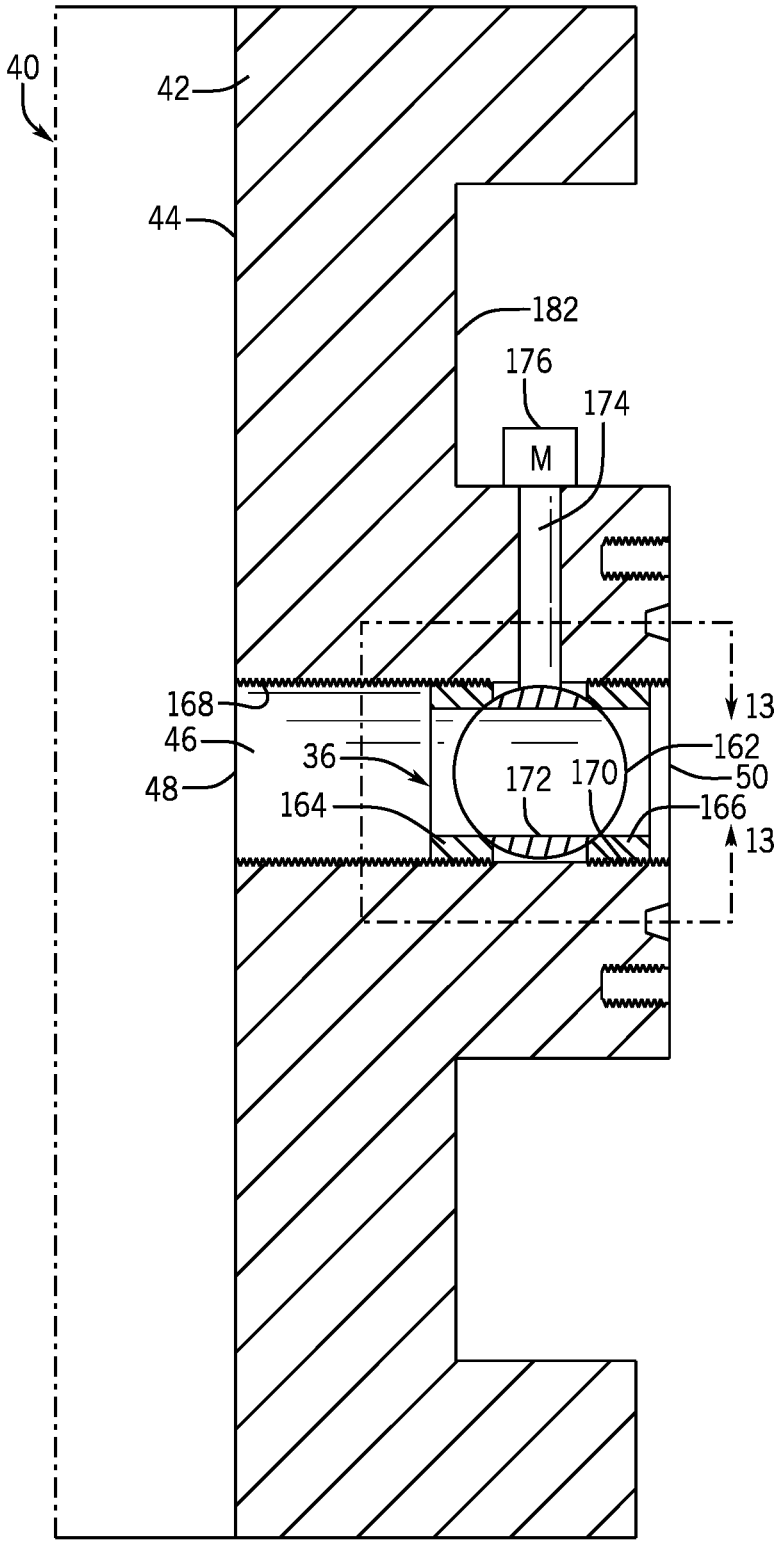
FIG. 12 is a cross-section of a portion of a pressure-containing component having an integrated ball valve for controlling flow through an access passage of the component in accordance with one embodiment.

A further example of an internal valve 36 integrated into the pressure-containing component 40 is shown in FIG. 12. In this embodiment, the valve 36 includes a ball 162 as a moveable sealing element. Seats 164 and 166 seal against opposing sides of the ball 162. In some embodiments, the seats 164 and 166 directly contact the ball 162 to provide metal-to-metal sealing, though other seals could also or instead be used, such as thermoplastic or elastomer seals carried by the seats 164 and 166.

The seats 164 and 166 may be installed in the access passage 46 in any suitable manner. As shown in FIG. 12, for instance, the seats 164 and 166 are threaded into the access passage 46 along threaded surfaces 168 and 170. The seat 164 can be installed through the inner end 48 of the passage 46 and the seat 166 can be installed through the outer end 50. But in other embodiments, both seats 164 and 166 could be installed through the same end of the passage 46.

Figure 13:
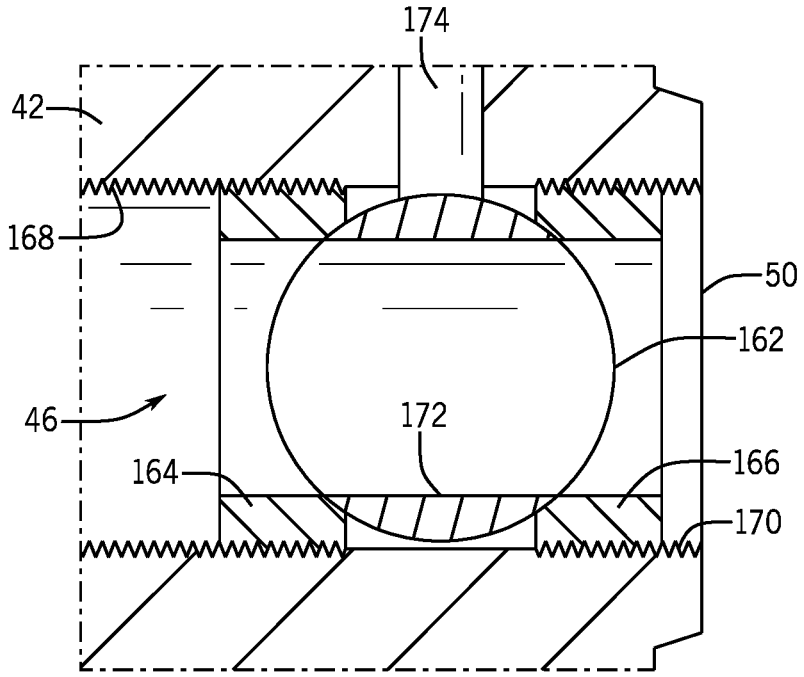
FIG. 13 is a detail view of the valve of FIG. 12 and shows the ball of the ball valve in an open position allowing flow through the access passage.
Figure 14:
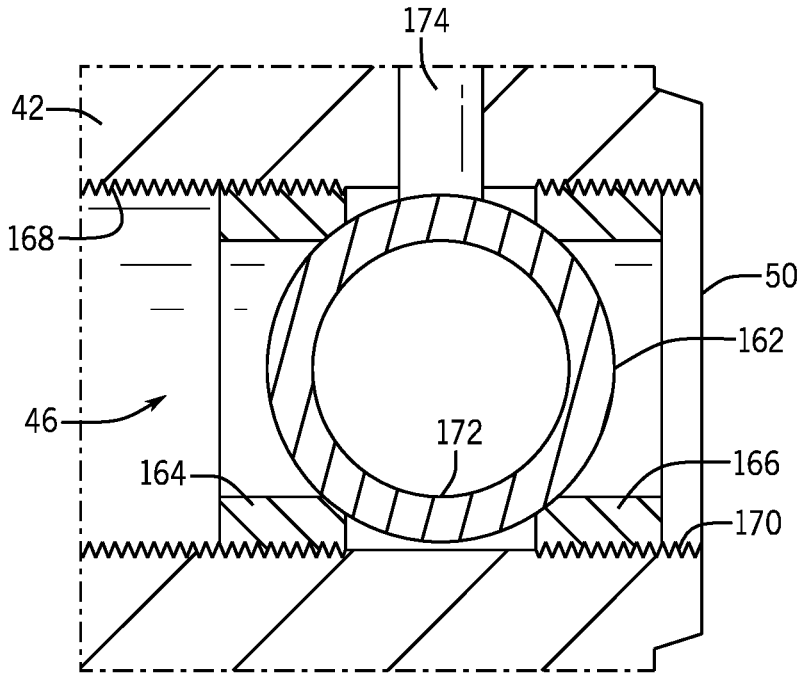
FIG. 14 is a detail view of the valve of FIGS. 12 and 13 and shows the ball in a closed position blocking flow through the access passage.

The ball 162 includes a bore 172 and can be rotated between open and closed positions to control flow through the valve 36 and the access passage 46. The ball 162 is shown in the open position in FIG. 13, in which the bore 172 is aligned with the access passage 46 to allow flow. The valve 36 can be closed by rotating the ball 162 to the closed position in FIG. 14. In this position, the bore 172 is no longer aligned with the access passage 46 and sealing between the ball 162 and the seats 164 and 166 blocks flow through the valve 36, which may facilitate removal of an external valve 32 as discussed above.

The ball 162 can be actuated with a mechanical actuator or in any other suitable manner. In the embodiment depicted in FIG. 12, the ball 162 is rotated via a stem 174 that extends through a control passage in the body 42 and is driven by a motor 176 (e.g., an electric motor or a hydraulic motor). Although other arrangements are envisaged, the motor 176 is shown in FIG. 12 to be installed above the ball 162 in a recessed portion 182 of the body 42 to facilitate use of a straight stem 174 along the axis of rotation of the ball 162.

Figure 15:
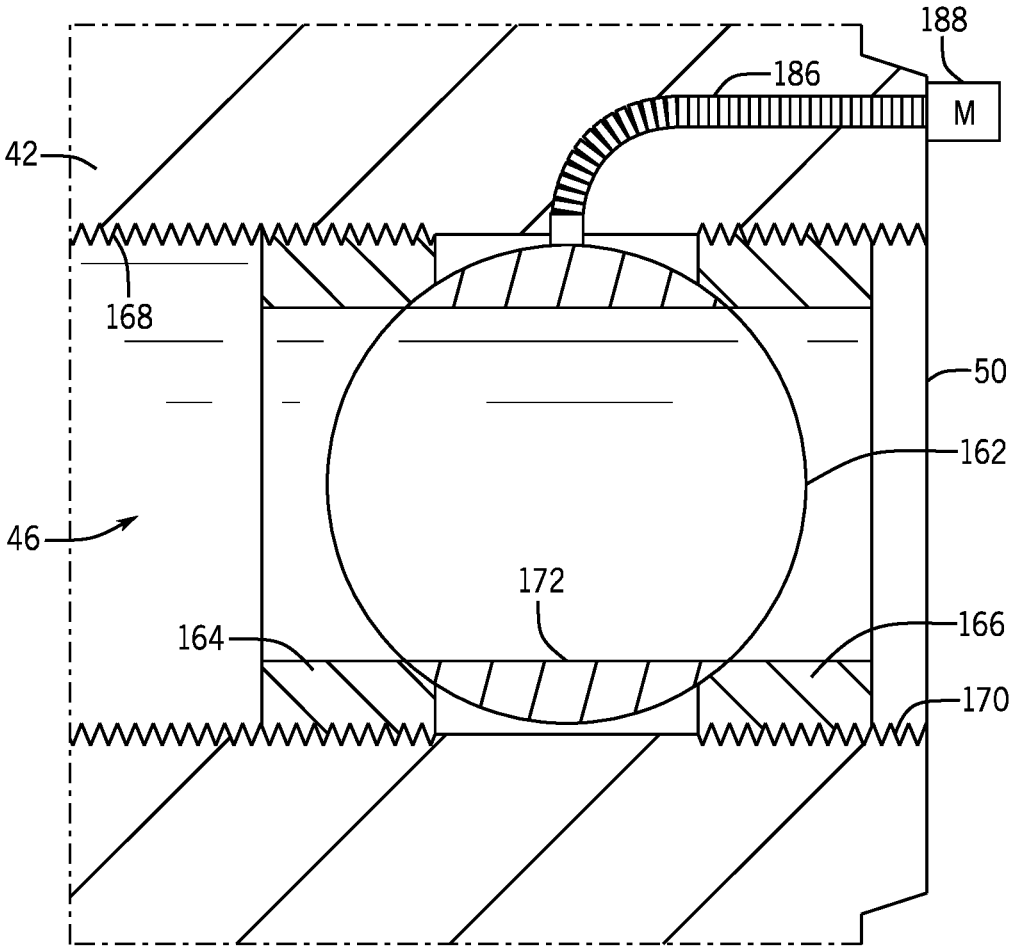
FIG. 15 is a detail view of a ball valve like that of FIG. 12 but having a flexible actuator for rotating the ball in accordance with one embodiment.

In other embodiments, the stem or other mechanical actuator for rotating the ball 162 could extend to some other surface of the body 42. In FIG. 15, for example, a flexible mechanical actuator 186 (e.g., a flex coil or flexible shaft) extends to a radially outward facing surface (e.g., a front face) of the body 42 and is coupled to a motor 188 for controlling rotation of the ball 162 between the open and closed positions. The actuator could also or instead include a U-joint to transmit torque from the motor 188 to the ball 162, such as a U-joint connecting an actuator shaft to a stem extending from the ball 162. In still other embodiments, the ball 162 could be manually rotated (e.g., with a handle connected to the stem 174, the actuator 186, or another actuator).

Figure 16:
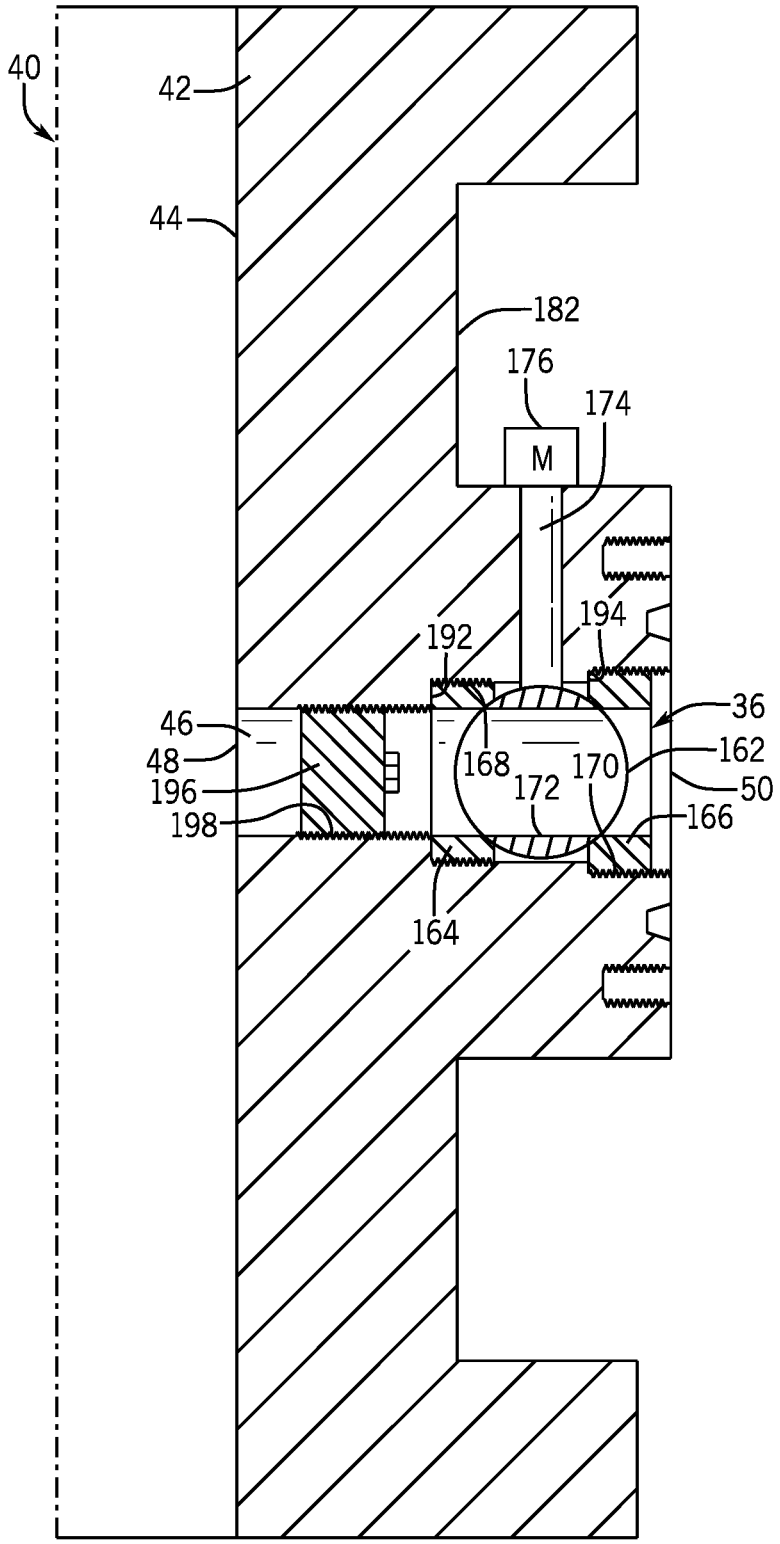
FIG. 16 is a cross-section of a portion of a pressure-containing component having an integrated ball valve and a sealing plug installed in an access passage of the component in accordance with one embodiment.

Although the ball 162 may be used to block flow through the access passage 46 and facilitate removal of an external valve 32, in some embodiments a sealing plug could also be installed in the access passage 46. One such example is shown in FIG. 16, in which the access passage 46 and the internal valve 36 permit installation of a sealing plug 196 (e.g., a VR plug). In this depicted embodiment, the seats 164 and 166 may both be installed through the outer end 50 of the access passage 46. During assembly, the seat 164 can be threaded into the access passage 46, and the ball 162 can be positioned in the access passage 46 after the seat 164. The seat 166 can then be threaded into the access passage 46. Shoulders 192 and 194 provide positive stop surfaces for the seats 164 and 166. As shown in FIG. 16, the outer diameter of the seat 164 is less than that of the seat 166 to facilitate passage of the seat 164 beyond the shoulder 194. The sealing plug 196 can be run through the outer end 50 and the open ball 162 (e.g., with an installation tool), and then threaded into a threaded surface 198 (e.g., a VR preparation) of the access passage 46.

While the access passage 46 is shown with a smaller diameter at the sealing plug 196 than at the seat 164, and with an integral shoulder 192 of the body 42 defining a step-change in the diameter of the passage 46, other arrangements could be used. By way of example, a sleeve could be installed in the access passage 46 of FIG. 12 between the seat 164 and the bore 44 to facilitate installation of the sealing plug 196. Rather than the body 42 having an integral shoulder 192, this sleeve could include the shoulder 192, as well as an internal threaded surface 198 for receiving the plug 196 and an external threaded surface for engaging threaded surface 168 of the access passage 46 in FIG. 12. The plug 196 could then be run into the sleeve through the ball 162 as generally described above. With the plug 196 blocking flow through the access passage 46, the internal valve 36 may be serviced, removed, or used as a second fluid barrier.

Figure 17:
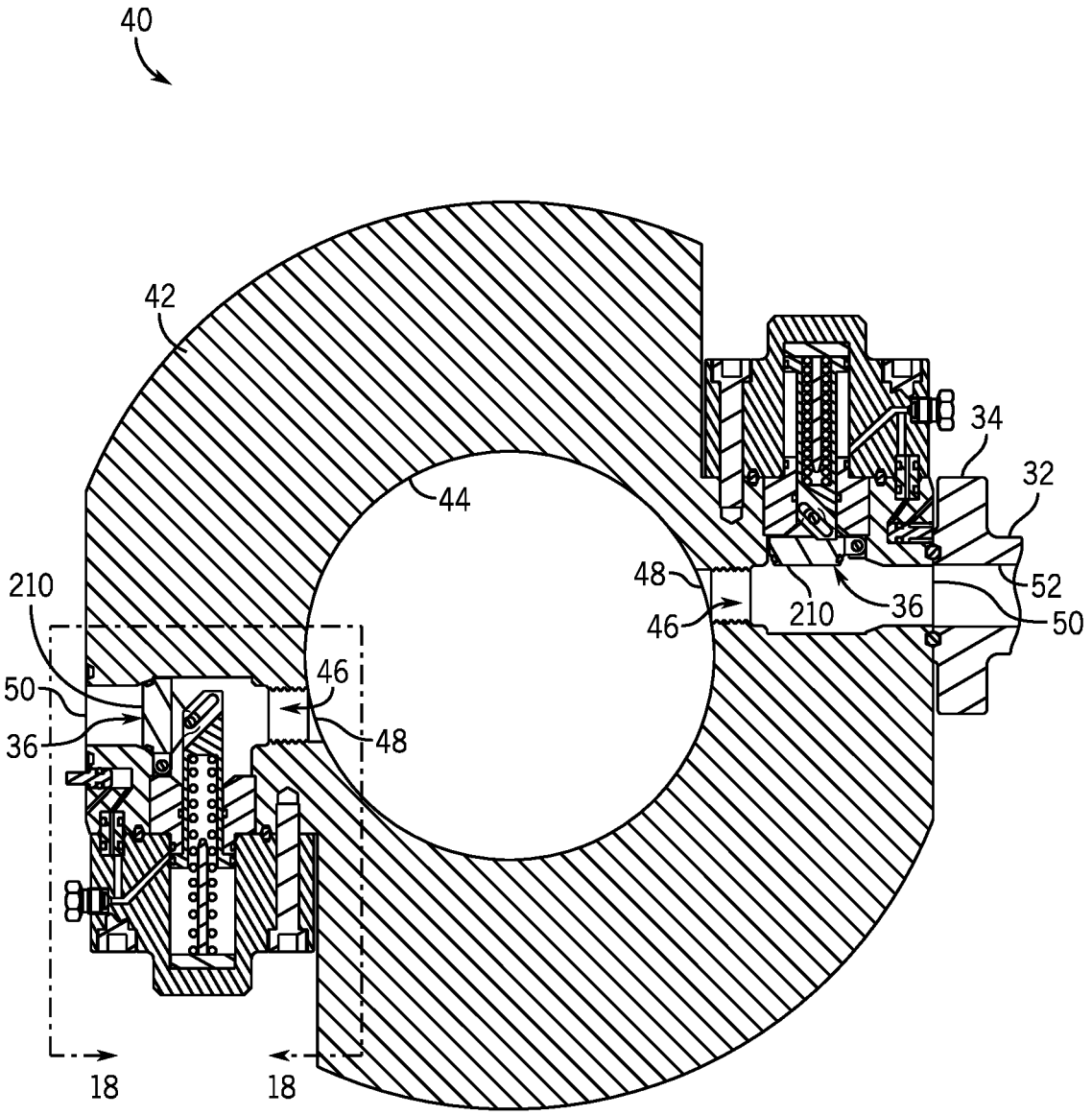
FIG. 17 is an axial cross-section of a pressure-containing component having integrated valves with hinged gates for controlling flow through access passages of the component in accordance with one embodiment.

Another example of an internal valve 36 integrated into a pressure-containing component 40 of the wellhead assembly 14 is shown in FIG. 17. More particularly, FIG. 17 depicts a pair of internal valves 36 with hinged gates 210 (i.e., hinged-gate valves) integrated into the hollow body 42 of the pressure-containing component 40 (e.g., a head 20 or other wellhead housing, or a tree 18). The gates 210 are positioned along the access passages 46 and swing between open and closed positions to control flow through the valves 36 and the access passages 46. In FIG. 17, the valve 36 on the left is shown with its gate 210 in a closed position to block fluid flow, and the valve 36 on the right is shown with its gate 210 in an open position to allow fluid flow.

External valves 32 may be mounted to the hollow body 42 in-line with access passages 46. One such external valve 32 is partially depicted on the right side of the body 42 aligned with one of the access passages 46 in FIG. 17, and another external valve 32 may be similarly connected to the left side of the body 42 and aligned with the other depicted access passage 46. While the axial cross-section of FIG. 17 depicts two access passages 46 with internal valves 36, it will be appreciated that the body 42 can include additional access passages 46, any or all of which may similarly include internal valves 36.

Figure 18:
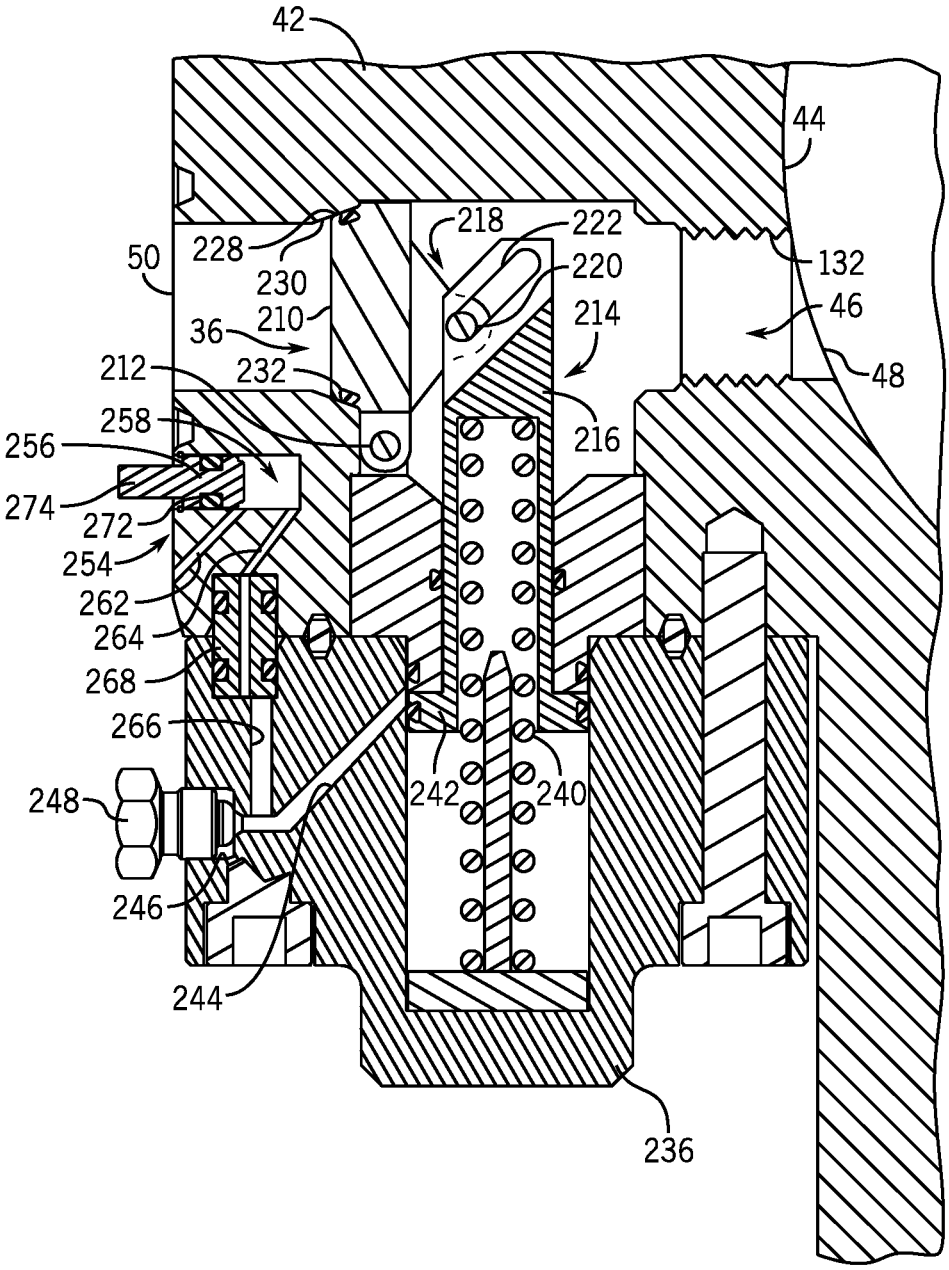
FIG. 18 is a detail view of an integrated hinged-gate valve of FIG. 17 and shows a hinged gate, an actuation assembly, and an automatic valve shut-off assembly in accordance with one embodiment.

Certain aspects of the hinged-gate internal valve 36 of FIG. 17 and its operation may be better understood with reference to the detailed view of FIG. 18. As shown, the internal valve 36 includes a gate 210 with a hinge 212 that allows the gate 210 to swing between closed and open positions within the body 42. Further, in at least some embodiments, an actuator is coupled to move the gate 210 between the closed and open positions. As depicted in FIG. 18, for instance, the valve 36 includes an actuation assembly 214 including a linearly moveable stem 216 connected to control swinging of the gate 210. The stem 216 may be connected to the gate 210 in any suitable manner. In at least some embodiments, the stem 216 is connected to the gate 210 with a pivot joint 218. In the specific example shown in FIG. 18, the pivot joint 218 includes a pin 220 through a slot 222 to fasten the gate 210 to the stem 216 (e.g., a clevis fastener).

The closed gate 210 is shown in FIG. 18 with a sealing surface 228 for closing against a mating sealing surface 230 of the body 42. In some instances, the gate 210 includes a seal 232 (e.g., an elastomer seal) carried in a groove of the sealing surface 228 for sealing against the surface 230 of the body 42 when the gate 210 is in the closed position. In other instances, the seal 232 could be provided in a groove of the sealing surface 230 or in some other seat against which the gate 210 closes. Further, the sealing surface 228 of the gate 210 may also or instead create a seal directly against the mating sealing surface 230 of the body 42 (e.g., a metal-to-metal seal of the gate 210 against the body 42), with or without a carried seal 232. When closed, pressure in the inner end 48 of the access passage 46 can push the back of the gate 210 and reinforce sealing of the gate 210 against the sealing surface 230.

The valve 36 of FIG. 18 may be installed transverse to the access passage 46. That is, rather than being inserted into the access passage 46 through either the inner end 48 or outer end 50, the gate 210 and the actuation assembly 214 may be inserted via a side passage (e.g., the perpendicular passage in the body 42 through which the actuation assembly 214 extends in FIG. 18). A bonnet 236 fastened to the body 42 encloses the gate 210 and the actuation assembly 214 within the body 42. As shown in FIGS. 17 and 18, the exterior of the body 42 may be recessed to facilitate receipt and connection of the bonnet 236.

Figure 20:
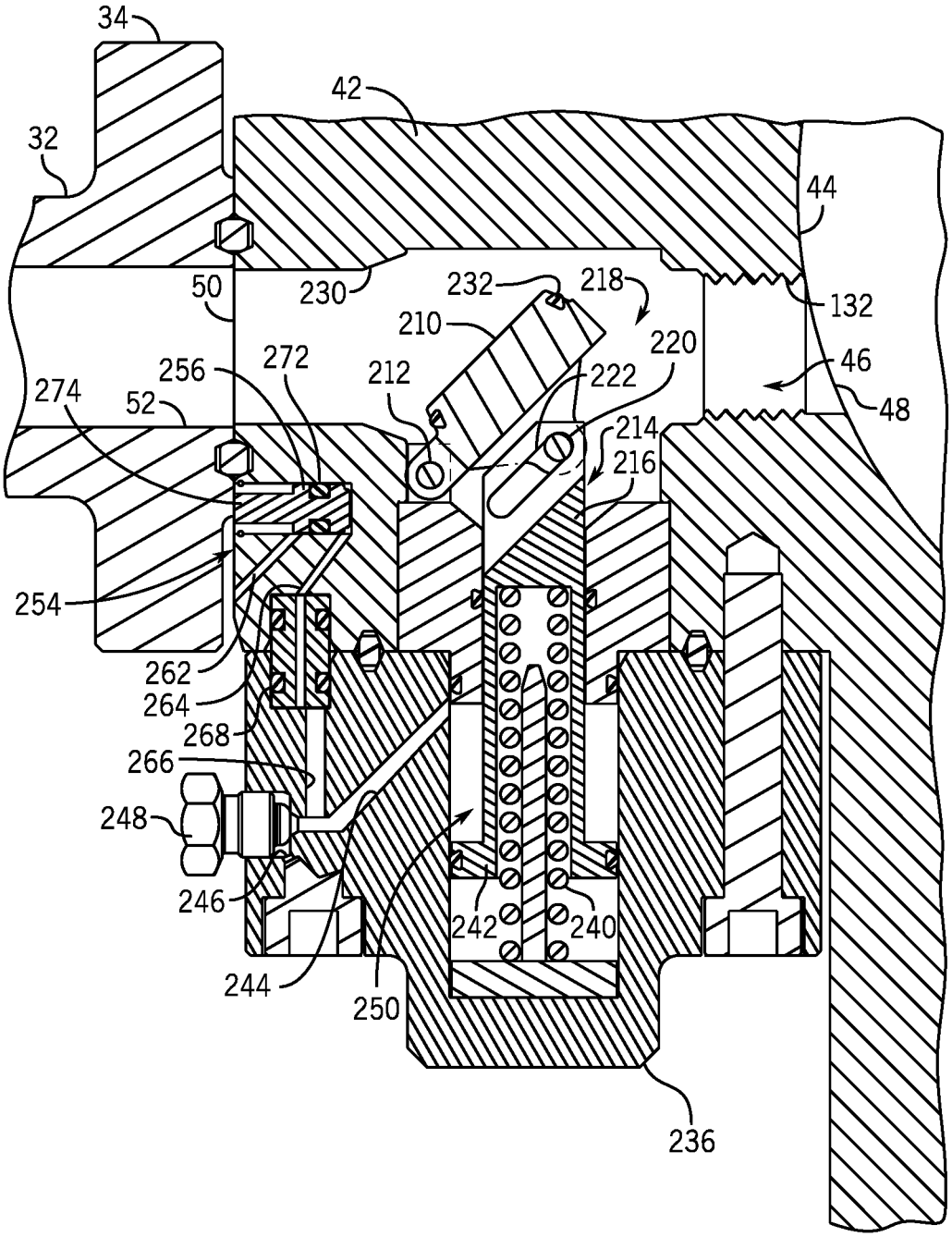
FIGS. 20 and 21 show the hinged gate of FIG. 19 in open positions allowing flow through the access passage.

Some embodiments include a spring 240 that biases the gate 210 toward its closed position. Although the biasing spring 240 is shown as a compression spring in FIG. 18, different forms of springs (e.g., torsion springs) may be used in other instances. The spring 240 in FIG. 18 pushes the stem 216 and biases the gate 210 toward the closed position. The stem 216 includes a piston 242, and the biasing force of the spring 240 may be overcome through actuation of the piston 242. Any suitable control fluid, such as a hydraulic control fluid in the case of a hydraulic actuation system 214, may be injected through an inlet port 246 and a conduit 244 into an interior working chamber 250 (FIG. 20) of the valve 36 to move the stem 216 against the biasing force of the spring 240 and open the hinged gate 210. A plug 248 may be inserted into the inlet port 246, such as when the valve 36 is kept in the closed position and is not in active use.

Figure 19:
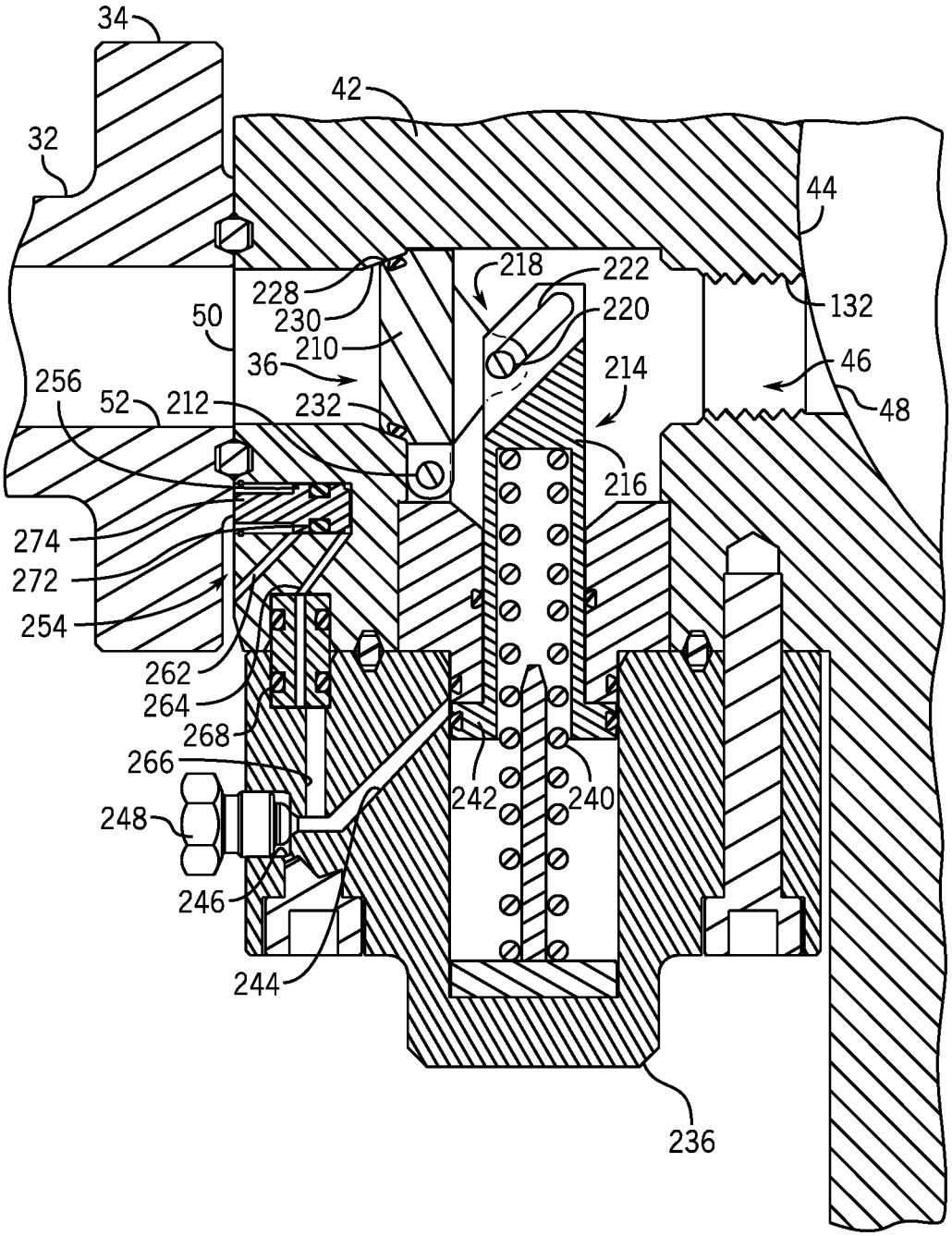
FIG. 19 shows an external valve coupled in-line with the access passage having the integrated hinged-gate valve of FIG. 18 and shows the hinged gate in a closed position to block flow in accordance with one embodiment.

The apparatus of FIG. 18 also includes an automatic valve shut-off assembly 254. This depicted shut-off assembly 254 includes a vent shuttle 256 installed in a chamber 258 of the body 42 and various conduits arranged to vent actuation pressure from the valve 36 upon movement of the shuttle 256 to a pressure-venting position. In FIG. 18, the vent shuttle 256 is shown at a pressure-venting position that allows fluid communication between conduits 262 and 264 of the body 42 through the chamber 258. A conduit 266 of the bonnet 236 is in fluid communication with the conduit 244 and the conduit 264 (via a seal sub 268). The vent shuttle 256 can be moved between a pressure-retaining position (e.g., as shown in FIG. 19) and a pressure-venting position (e.g., as shown in FIG. 18) that allows pressure to vent from the chamber 250 and cause the gate 210 to move to the closed position. That is, with the shuttle 256 in the position depicted in FIG. 18, conduits 262 and 264 are in fluid communication and provide a vent path for actuation pressure to escape the valve 36 (i.e., from the chamber 250 and through the conduit 244, the conduit 266, the seal sub 268, the conduit 264, the chamber 258, and the conduit 262), allowing the spring 240 to drive the gate 210 closed. In contrast, when the shuttle 256 is moved to the pressure-retaining position of FIG. 19, the shuttle 256 (e.g., via a carried seal 272) isolates conduit 262 from conduit 264 and prevents venting of the actuation pressure from the valve 36 through the conduit 262.

Figure 21:
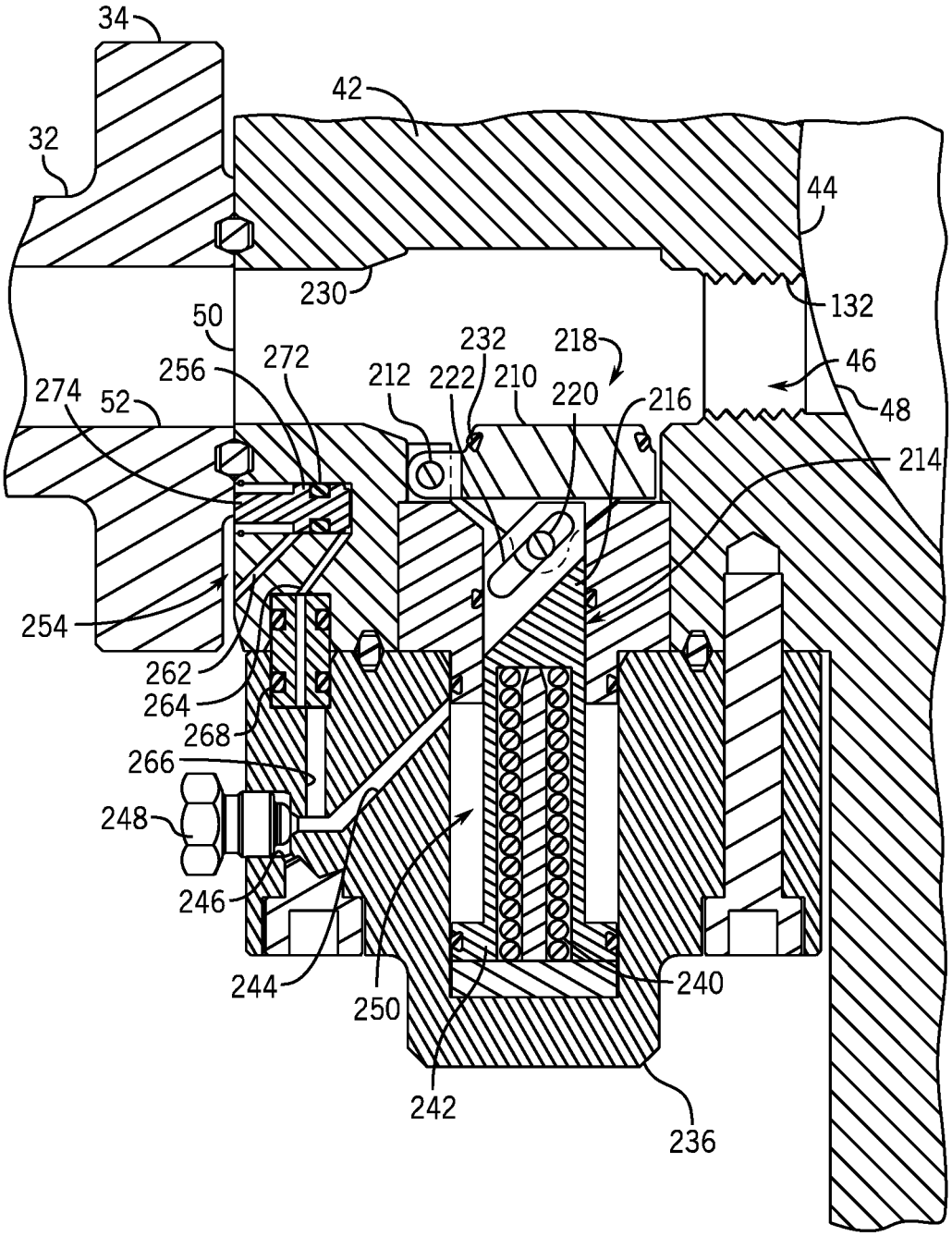

In some instances, the shuttle 256 includes a stem 274 that protrudes outwardly from the body 42 when the shuttle 256 is in the pressure-venting position, such as shown in FIG. 18. In use, however, an external valve 32 (or other component, such as a flanged pipe or an instrument flange) can be connected to the body 42 in-line with the access passage 46 and hold the shuttle 256 in the pressure-retaining position shown in FIG. 19. The external valve 32 or other component can be connected to the body 42 in any suitable manner, such as with studs, nuts, bolts, or other fasteners. With the shuttle 256 held in the position shown in FIG. 19, hydraulic control fluid may be pumped into the chamber 250 through the inlet port 246 and the conduit 244 to retract the stem 216 and swing the gate 210 from the closed position to open positions depicted in FIG. 20 (half-open) and FIG. 21 (fully open). It will be appreciated that the amount by which the gate 210 opens may be controlled by the amount of hydraulic fluid pumped into the valve 36. In the pivot joint 218, the slot 222 may be angled with respect to both the flow direction through the valve 36 and the direction of stem movement to allow translation of the pin 220 in the slot 222 during retraction of the stem 216 and opening of the gate 210.

With hydraulic pressure in the chamber 250 holding the gate 210 in an open position that allows flow through the valve 36, various fluids may be injected into or vented from the bore 44 through the access passage 46. When finished, the valve 36 may be closed by reducing pressure within the chamber 250 and allowing the hydraulic control fluid to flow out of the valve (e.g., via port 246 or another port). But if the external valve 32 or other component holding the shuttle 256 in the pressure-retaining position (FIGS. 19-21) is removed while the gate 210 is open, such as if the external valve 32 is accidentally separated from the body 42 during injection or venting of fluid through the internal valve 36, the hydraulic control pressure (from the valve 36 via the conduit 264) acts on the right face of the shuttle 256 in FIGS. 19-21 and pushes the shuttle 256 to the pressure-venting position of FIG. 18. This puts the conduits 264 and 262 in fluid communication, causes the hydraulic control fluid to vent to atmosphere from the chamber 250 in the bonnet 236, as described above, and allows the spring 240 to push the stem 216 and return the gate 210 to its closed position. In this manner, the automatic valve shut-off assembly 254 can generally operate to automatically close the gate 210 if the shuttle 256 is not held in its pressure-retaining position while the gate 210 is opened, as well as to prevent hydraulic actuation of the valve 36 unless the shuttle 256 is in its pressure-retaining position. Still further, in at least some embodiments, the stem 274 of the shuttle 256 is a visual indicator that signals the gate 210 is closed when the stem 274 is protruding outwardly from the body 42, such as shown in FIG. 18.

Figure 22:
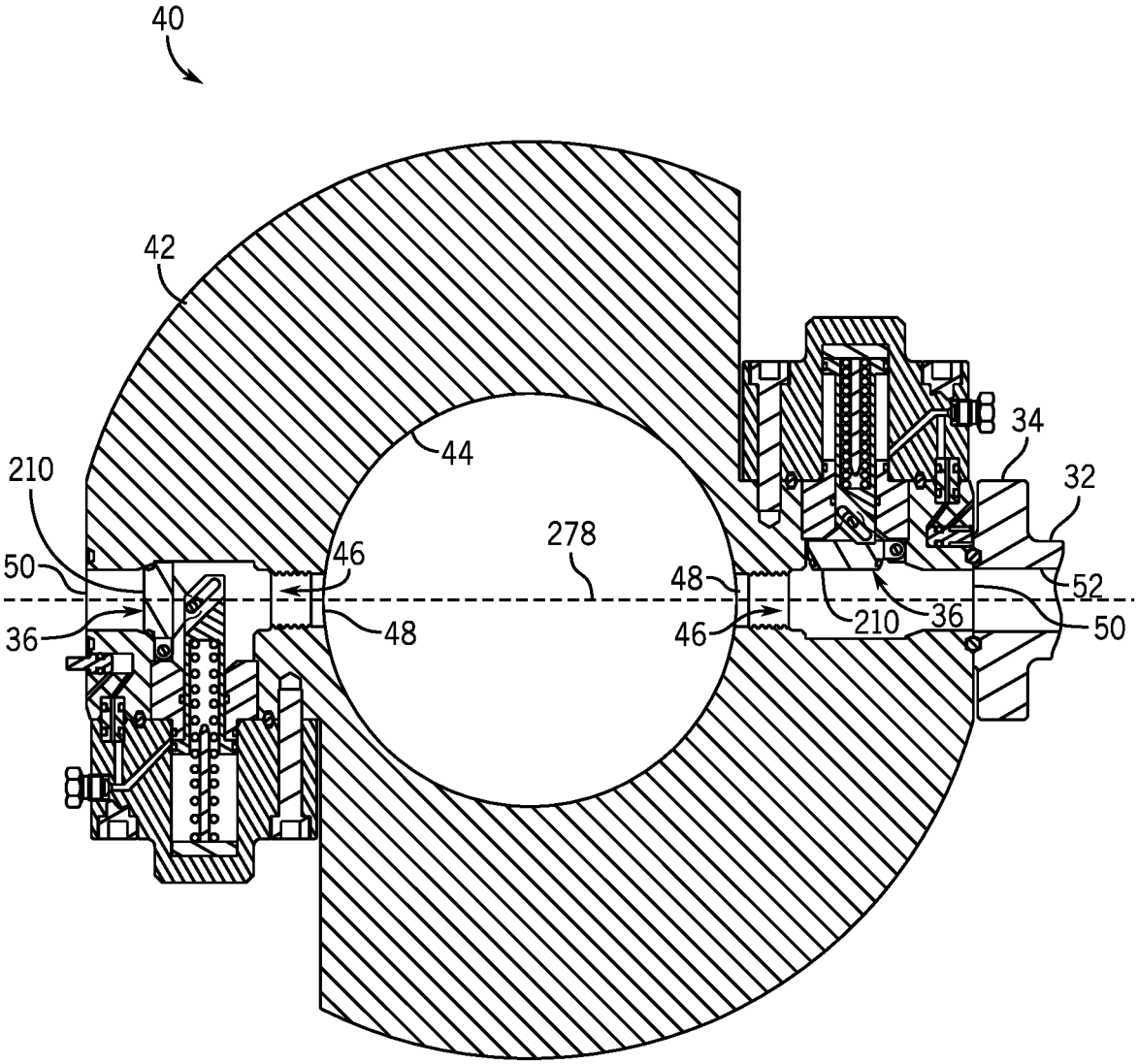
FIG. 22 is an axial cross-section of a pressure-containing component having integrated valves with hinged gates for controlling flow through access passages of the component in which the access passages are aligned along an axis and extend radially through the pressure-containing component in accordance with one embodiment.

As described with other embodiments above, a plug 134 (e.g., a VR plug) can be inserted through the valve 36 and threaded to a threaded surface 132 (e.g., a VR preparation) of the body 42 to provide an additional barrier and facilitate removal of the external valve 32 or the internal valve 36. In some instances, such as shown in FIG. 22, the body 42 includes a pair of access passages 46 that are aligned with one another (e.g., along centerline 278) and extend radially through the body 42. This is in contrast to the arrangement shown in FIG. 17, in which the access passages 46 are not aligned with one another (they are offset from a centerline) and do not extend radially through the body 42. Again, the body 42 can include additional access passages 46, each of which may or may not be aligned with another access passage 46.

While the hinged-gate valves described above with respect to FIGS. 17-22 can be used as internal valves integrated into a pressure-containing component of a wellhead assembly, in other embodiments the hinged-gate valves may be provided as standalone valves that are not integrated into a pressure-containing component of a wellhead assembly. In some instances, for example, such valves may be used as an external valve 32 described above, a production valve, or a pipeline valve.

Figure 23:
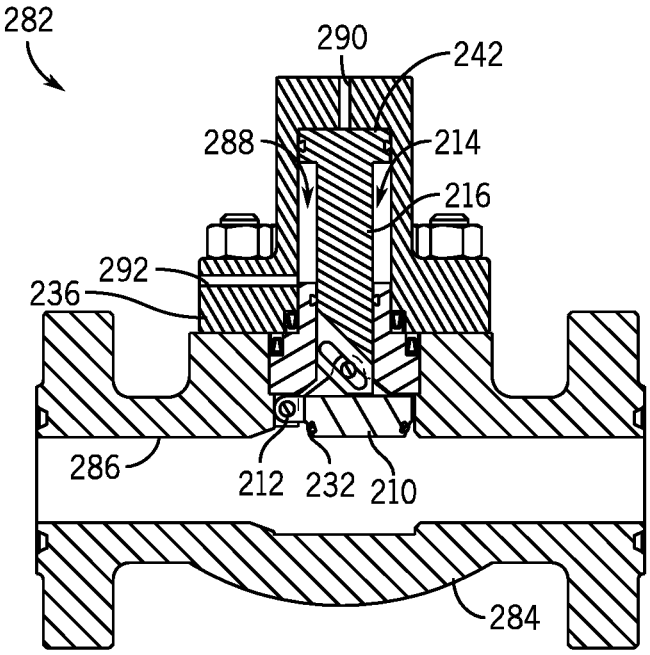
FIGS. 23 and 24 depict a hydraulically actuated valve with a hinged gate in a valve housing in accordance with one embodiment.
Figure 24:
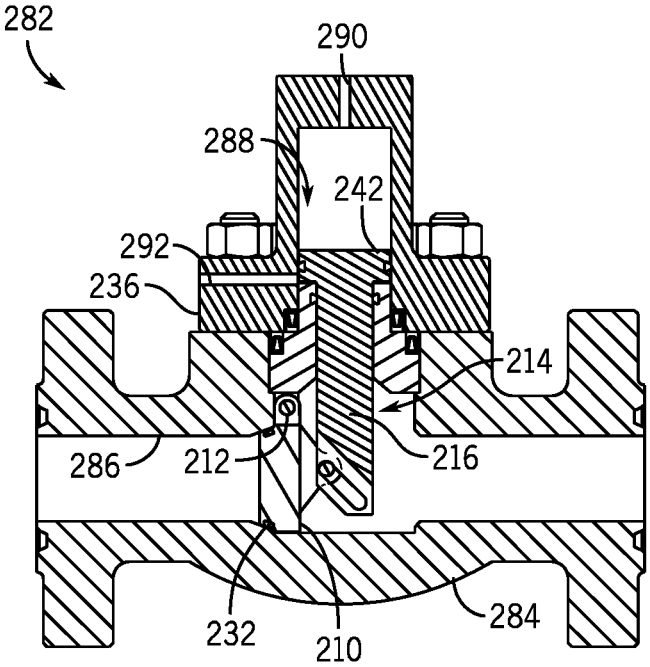
Figure 25:
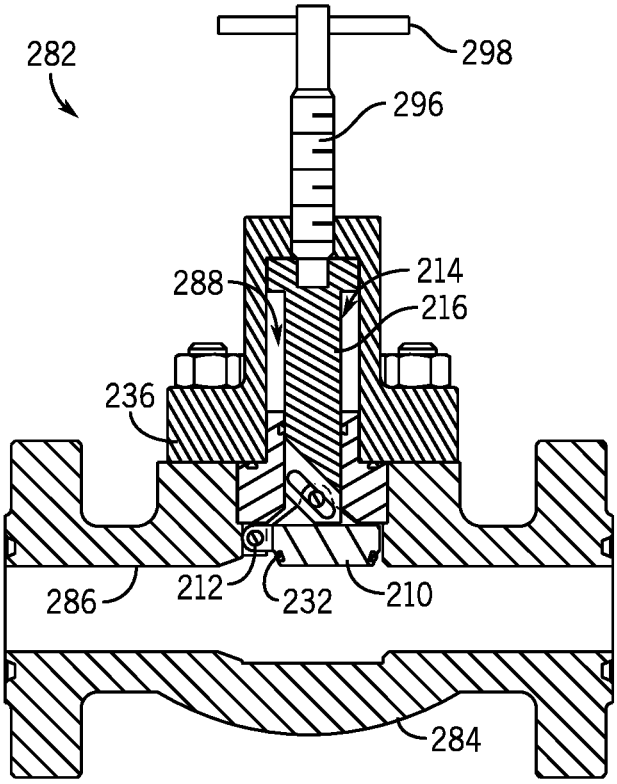
FIGS. 25 and 26 depict a manually actuated valve with a hinged gate in a valve housing in accordance with one embodiment.
Figure 26:
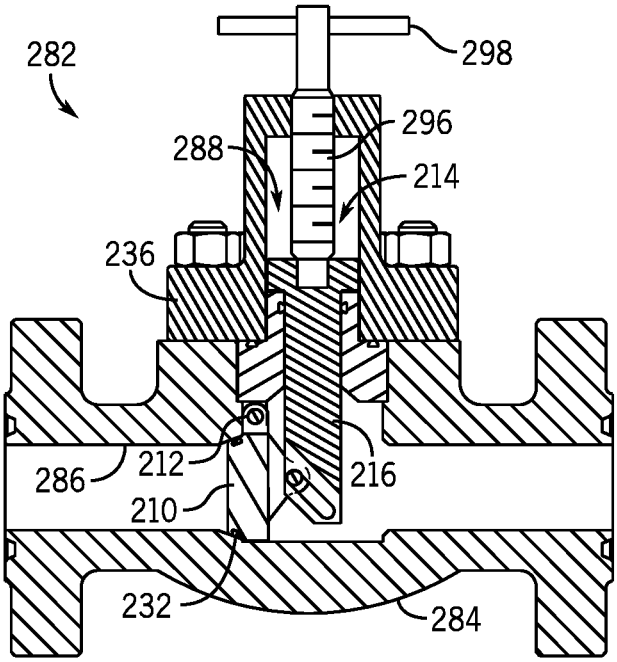

By way of example, a valve 282 with a hinged gate 210 is depicted in FIGS. 23 and 24. The gate 210, the hinge 212, and the actuation assembly 214 are enclosed in a valve housing 284 with a bonnet 236. A stem 216 of the actuation assembly 214 can be connected to the gate 210, such as described above. In the embodiment shown in FIGS. 23 and 24, the gate 210 can be opened and closed through hydraulic actuation (via the piston 242 and the stem 216) to selectively control flow through a bore 286 of the valve 282. In the closed position, the gate 210 can seal against a mating surface of the valve housing 284 (or of a seat installed in the housing 284), such as with either or both an elastomer seal and a metal-to-metal seal. Hydraulic fluid can be routed into a chamber 288 of the valve 282 through a conduit 290 to drive the gate 210 to a closed position (FIG. 24) or through a conduit 292 to drive the gate 210 to an open position (FIG. 23). In some other embodiments, the valve 282 may be manually actuated. One example of this is shown in FIGS. 25 and 26, in which a handwheel or other handle 298 may be rotated to drive the stem 216 via a threaded rod 296 to move the gate 210 between an open position (FIG. 25) and a closed position (FIG. 26). In still other embodiments, a mechanical actuator may be used to drive the gate 210 of the valve 282 between open and closed positions.

The valve 282 is a standalone valve capable of use independent of a wellhead assembly and is not integrated into a wellhead housing, tree, or other pressure-containing component of a wellhead assembly. In some instances, the valve 282 could be used as an external valve 32 mounted on an exterior of a pressure-containing component of a wellhead assembly. But the valve 282 could also be used to control flow in other applications apart from wellhead assemblies.

Figure 27:
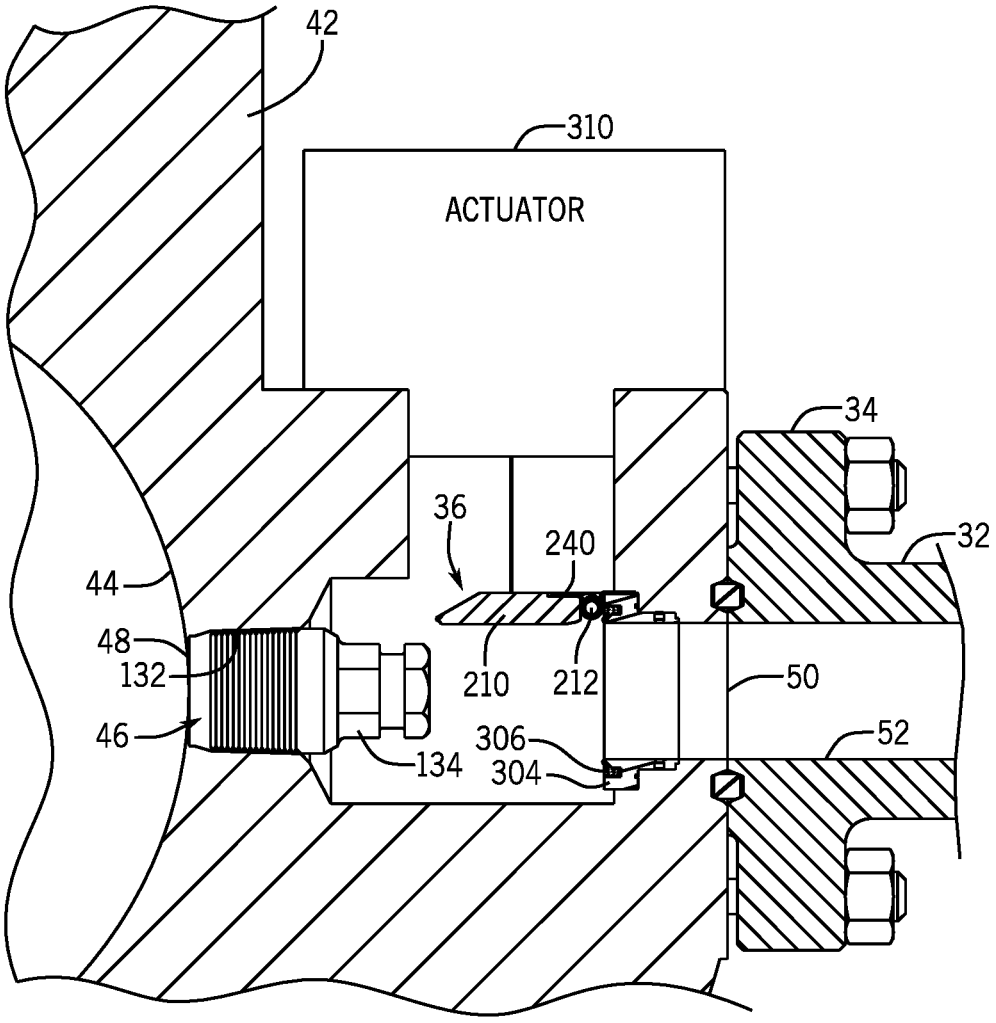
FIGS. 27-29 depict valves integrated into a pressure-containing component and having swinging gates that close against seats in accordance with certain embodiments.

In another embodiment depicted in FIG. 27, the body 42 includes an internal valve 36 with a hinged gate 210 that swings between an open position (as shown in FIG. 27) to allow flow through the valve 36 and a closed position against a seat 304 to block flow through the valve 36. The depicted seat 304 includes a seal 306 (e.g., a metal or elastomer seal) that seals against the gate 210 when closed. This valve 36 also includes a biasing spring 240, which is shown in FIG. 27 as a torsion spring. In some embodiments, the torsion spring 240 biases the gate 210 toward its closed position against the seat 304. A plug 134 (e.g., a VR plug) can be threaded to the threaded surface 132, as described above.

Figure 28:
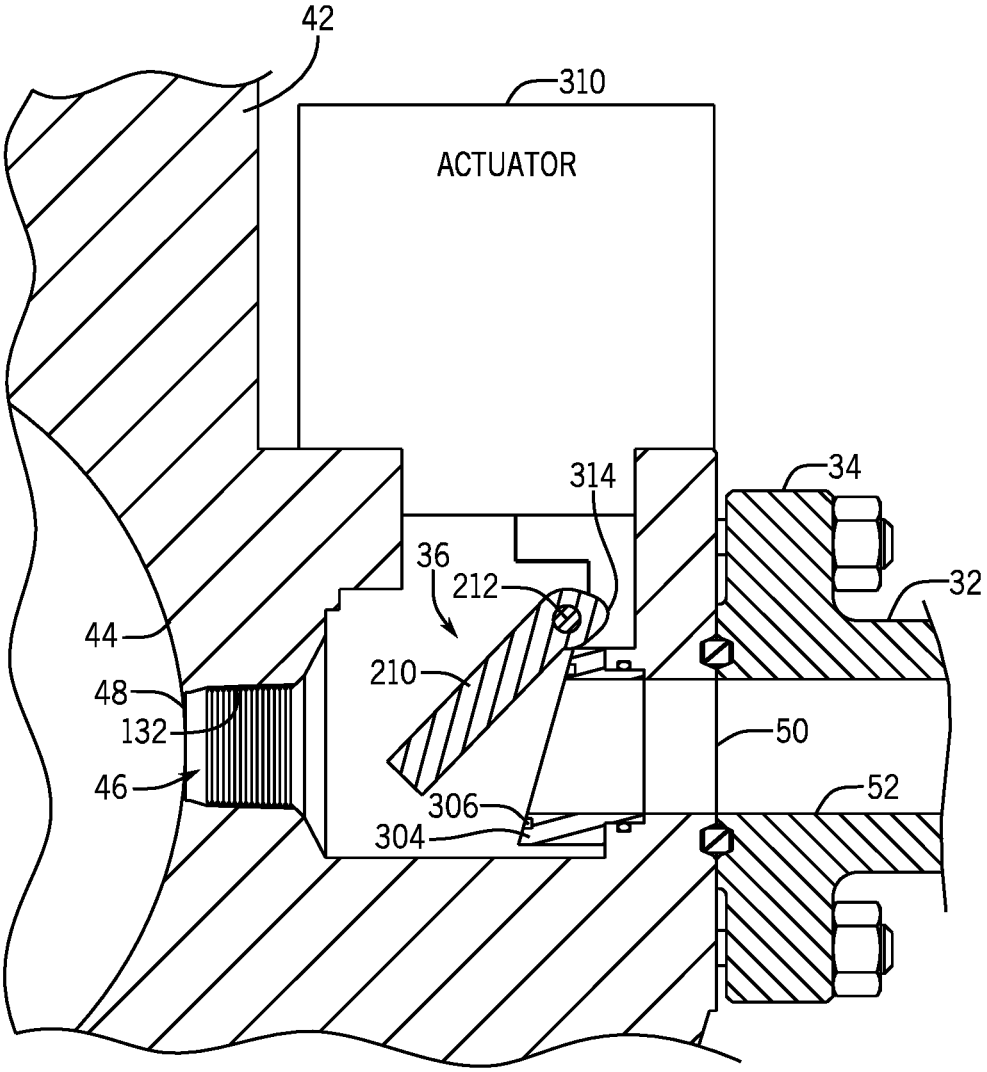

While various actuators are described above with respect to the hinged-gate valves of FIGS. 17-26, it will be appreciated that any other suitable actuators may be used to move the hinged gate 210 between closed and open positions in accordance with the present techniques. Accordingly, an actuator 310 is generally depicted in FIGS. 27 and 28 as being connected to move the gate 210. The actuator 310 may take the form of an actuator described above or of any other suitable actuator. The actuator 310 may be enclosed within a bonnet 236 in some embodiments or coupled to the body 42 in some other manner. Additionally, while certain embodiments described above in connection with FIGS. 17-22 include a hinged gate 210 and an automatic shut-off assembly 254 for venting hydraulic control fluid in some instances, other embodiments having hinged gates 210 may omit such a shut-off assembly 254.

In FIG. 28, the actuator 310 is connected to push against a cam surface 314 of the gate 210 to facilitate swinging the gate 210 from a closed position (against the seat 304) to an open position (off of the seat 304) to allow flow through the valve 36. The seat 304 may have an angled sealing face, such as shown in FIG. 28. This arrangement keeps the gate 210 from being perpendicular to the flow direction through the access passage 46 when the gate 210 is closed against the angled sealing face and may facilitate opening of the gate 210 off the seat 304 during operation. A seal 306 (e.g., carried in a groove of the seat 304) can be used to seal between the seat 304 and the closed gate 210. The seats 304 of FIGS. 27 and 28 could be used in other embodiments, including those described above with respect to FIGS. 17-26. Further, while not shown in FIG. 28, it will be appreciated that a biasing spring 240, such as a compression spring or a torsion spring, can be used to bias the gate 210 closed in some instances.

Figure 29:
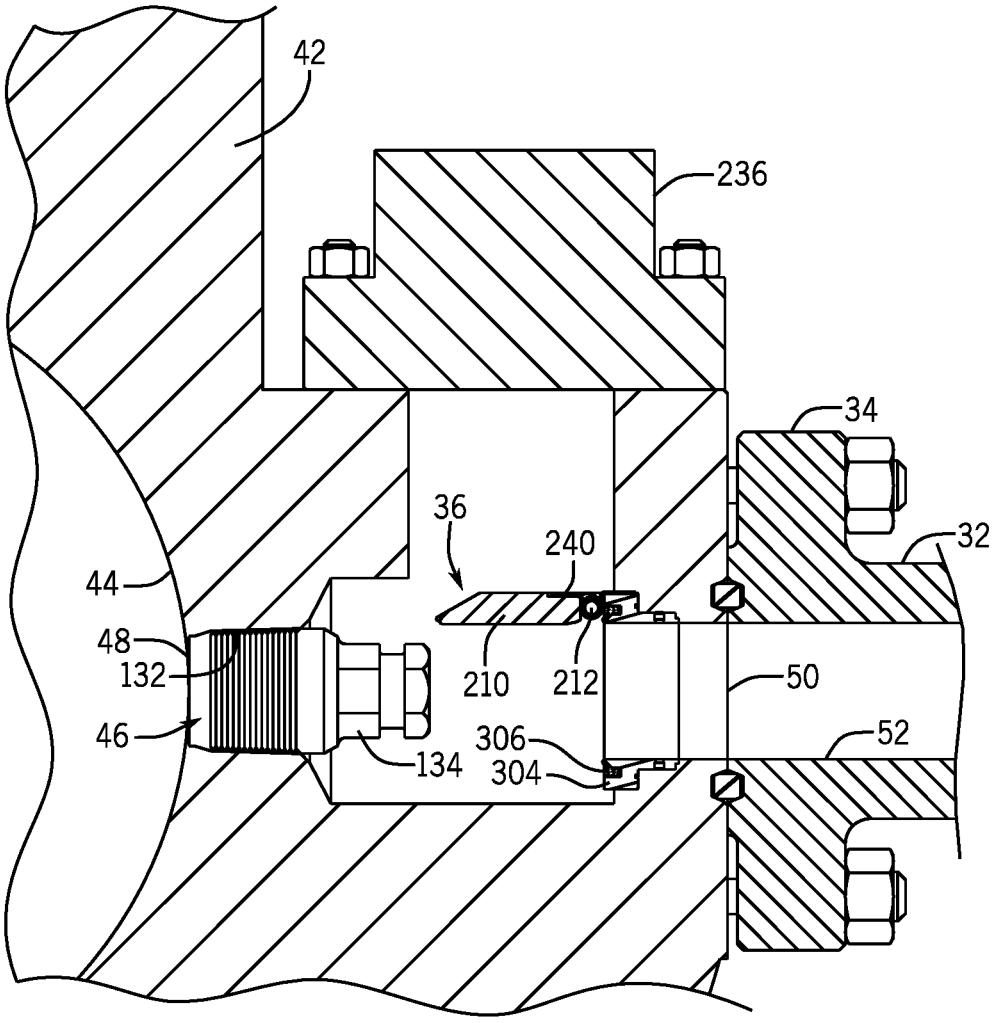

In some other embodiments, the valve 36 includes a hinged gate 210 without an actuator. One example of this is shown in FIG. 29, in which the gate 210 is enclosed within the access passage 46. The gate 210 is shown here in an open position but may be biased by spring 240 toward a closed position against the seat 304. In operation, movement of the hinged gate 210 is controlled by a pressure differential across the gate 210 without an actuator. When the gate 210 is closed and the pressure is greater at the inner end 48 of the access passage 46 than the outer end 50, the pressure differential pushes the gate 210 against the seat 304 and reinforces sealing of the closed gate 210. But when pressure at the outer end 50 sufficiently exceeds the pressure at the inner end 48 (i.e., by enough to overcome the biasing force from the spring 240), such as when injecting a fracturing fluid or some other fluid into the bore 44 through the access passage 46, the pressure differential pushes the gate 210 open and allows fluid flow. With the gate 210 open, a plug 134 can be installed in the access passage 46 via threaded portion 132, as described above.

Figure 30:
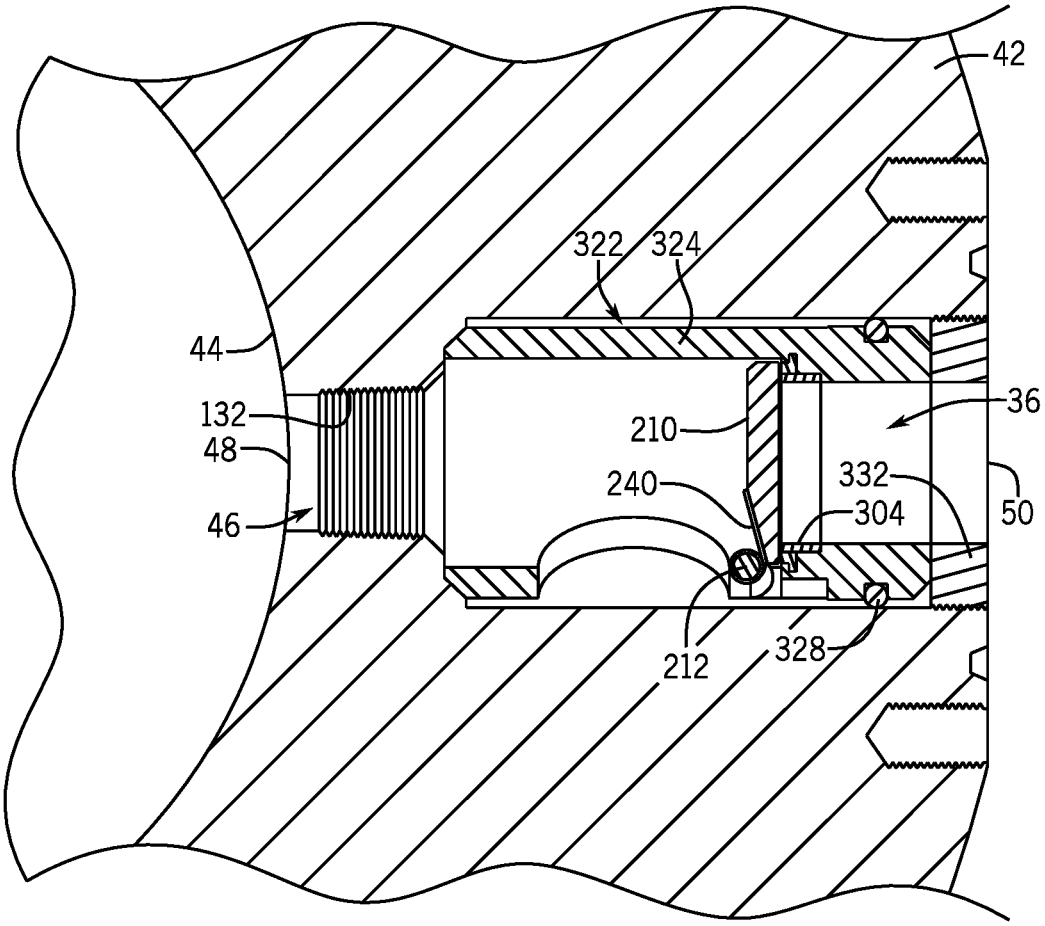
FIG. 30 shows a cartridge valve with a swinging gate installed in an access passage of a pressure-containing component in accordance with one embodiment.

In still another embodiment, an internal hinged-gate valve 36 can be provided as a cartridge valve. In FIG. 30, for example, an internal valve 36 includes a cartridge valve 322 having a gate 210, a hinge 212, a biasing spring 240, and a seat 304 housed within a hollow cartridge body 324. The cartridge valve 322 may be installed as a single unit, such as by inserting the cartridge body 324 with the internal valve components into the access passage 46 through the outer end 50. Like FIG. 29, the spring 240 can bias the hinged gate 210 to a closed position against the seat 304 and a pressure differential can be used to control movement of the hinged gate 210 without an actuator. In other cartridge valves 322, however, an actuator could also or instead be used to move the hinged gate 210. One or more seals 328 can be provided to seal within the access passage 46 between the body 42 and the outer surface of the cartridge body 324. Additionally, the cartridge body 324 may be retained within the access passage 46 with a retaining ring 332 or in any other suitable manner.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a pressure-containing component of a wellhead assembly, the pressure-containing component including a hollow body, a bore within the hollow body, and an access passage that is in the hollow body and is in fluid communication with the bore, the access passage having an inner end at the bore and an outer end opposite the inner end; and a valve coupled to the pressure-containing component, wherein the valve includes a sealing element that is positioned along the access passage and is selectively moveable between a closed position to block fluid flow through the access passage and an open position to allow fluid flow through the access passage, and wherein the valve is arranged such that, during operation, the sealing element is moved between the closed position and the open position without actuating the sealing element through the outer end of the access passage, and wherein the sealing element includes a gate installed in the hollow body along the access passage, and wherein the gate is a hinged gate configured to swing between the closed position and the open position.

2. The apparatus of claim 1, wherein the valve is a hydraulically actuated valve.

3. The apparatus of claim 1, comprising a seat installed along the access passage, wherein the seat seals against the gate.

4. The apparatus of claim 3, wherein the gate includes an aperture and is arranged such that the aperture is aligned with the seat and the access passage when the gate is in the open position.

5. The apparatus of claim 1, wherein the access passage includes a threaded surface between the inner end of the access passage and the gate.

6. The apparatus of claim 5, comprising a plug installed in the access passage via the threaded surface of the access passage and a mating threaded surface of the plug.

7. The apparatus of claim 1, wherein the access passage is an annulus access passage of a wellhead.

8. The apparatus of claim 1, comprising an automatic valve shut-off assembly including a vent shuttle installed in the pressure-containing component of the wellhead assembly, wherein the vent shuttle is moveable from a pressure-retaining position to a pressure-venting position to allow hydraulic pressure to vent from the hydraulic actuator and cause the hinged gate to move to the closed position.

9. An apparatus comprising:

a hollow body of a wellhead or of a tree, the hollow body including a bore, an access passage extending outwardly through a side of the hollow body from the bore toward an exterior of the hollow body, and a cavity intersecting the access passage; and a valve integrated into the hollow body so as to control flow, between the exterior of the hollow body and the bore, through the access passage, wherein the valve includes a gate that is installed in the cavity of the hollow body and is arranged to move between an open position allowing flow through the access passage and a closed position blocking flow through the access passage.

10. The apparatus of claim 9, comprising a mechanical actuator coupled to drive the gate between the closed position and the open position.

11. The apparatus of claim 10, wherein the mechanical actuator includes at least one of a drive gear or a motor.

12. A method comprising:

providing a valve including a sealing element moveable between an open position and a closed position; and integrating the valve into a body of a pressure-containing component of a wellhead assembly, the pressure-containing component including: the body, a bore within the body, and an access passage that is in the body and is in fluid communication with the bore, the access passage having an inner end at the bore and an outer end opposite the inner end;

wherein integrating the valve into the body of the pressure-containing component includes positioning the sealing element along the access passage such that the sealing element is selectively moveable between the closed position to block fluid flow through the access passage and the open position to allow fluid flow through the access passage and such that the valve does not protrude outwardly from the access passage of the pressure-containing component.

13. The method of claim 12, wherein integrating the valve into the body of the pressure-containing component includes inserting the valve into the access passage from the bore.

14. The method of claim 12, wherein the sealing element is a gate, the body of the pressure-containing component is a multi-piece body having a first body portion and a second body portion, and integrating the valve into the body of the pressure-containing component includes installing the gate in a cavity between the first body portion and the second body portion.

15. The method of claim 14, wherein installing the gate in the cavity between the inner body and the outer body includes fastening the outer body to the inner body to enclose the gate in the cavity.

16. The method of claim 14, wherein integrating the valve into the body of the pressure-containing component includes connecting a motor to drive movement of the gate between the open position and the closed position.

17. The method of claim 14, comprising fastening an external valve or flange to the first body portion so as to enclose the second body portion with a gasket received between the first body portion and the external valve or flange.

18. The method of claim 12, comprising measuring at least one of temperature or pressure of a fluid in the pressure-containing component.

19. The method of claim 12, comprising installing a sealing plug in the access passage through the valve such that both the sealing plug and the sealing element of the valve are within the body of the pressure-containing component.

* * * * *